US009884735B2

(12) United States Patent
Ozeki

(10) Patent No.: US 9,884,735 B2
(45) Date of Patent: Feb. 6, 2018

(54) SHEET TRAY AND SHEET CONVEYING APPARATUS

(71) Applicant: BROTHER KOGYO KABUSHIKI KAISHA, Nagoya-shi, Aichi-ken (JP)

(72) Inventor: Naoto Ozeki, Konan (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/417,979

(22) Filed: Jan. 27, 2017

(65) Prior Publication Data

US 2017/0217702 A1 Aug. 3, 2017

(30) Foreign Application Priority Data

Jan. 29, 2016 (JP) ..... 2016-016561

(51) Int. Cl.
*B65H 1/00* (2006.01)
*B65H 1/04* (2006.01)
*B41J 11/58* (2006.01)

(52) U.S. Cl.
CPC ..... *B65H 1/00* (2013.01); *B41J 11/58* (2013.01); *B65H 1/04* (2013.01); *B65H 2402/343* (2013.01); *B65H 2801/06* (2013.01)

(58) Field of Classification Search
CPC .... B65H 1/00; B65H 1/04; B65H 2405/1116; B65H 2405/11161; B65H 2405/11164; B65H 2511/11; B65H 2402/343
USPC ..... 271/171
See application file for complete search history.

(56) References Cited

U.S. PATENT DOCUMENTS 6,053,493 A * 4/2000 Yokoyama ..... B65H 1/266 211/126.7
7,070,350 B2 * 7/2006 Inokuchi ..... B41J 13/106 271/171
8,272,637 B2 * 9/2012 Asada ..... B65H 1/04 271/171
2004/0036208 A1 * 2/2004 Yanagi ..... B65H 3/0661 271/171
2009/0224463 A1 * 9/2009 Chinzei ..... B65H 31/02 271/207

(Continued)

FOREIGN PATENT DOCUMENTS

JP 2008-100806 A 5/2008
JP 2011-235986 A 11/2011
JP 2015-110471 A 6/2015

*Primary Examiner* — David H Bollinger
(74) *Attorney, Agent, or Firm* — Merchant & Gould P.C.

(57) ABSTRACT

There is provided a sheet tray including: a first tray; a second tray supported by the first tray; and a third tray supported by the second tray. The second tray has a first engaging section engageable with the first tray at a second position; the third tray has a second engaging section contactable with the second tray, in a drawing direction from a first position toward the second position, at a fifth position between a third and a fourth position, and engageable with the second tray at the fourth position. The second engaging section is configured to be elastically deformable to be movable in a releasing direction in which the contact between the second engaging section and the second tray is released. The second and third trays are moved integrally in the drawing direction in a state that the second engaging section makes contact with the second tray.

9 Claims, 15 Drawing Sheets

(56) References Cited

U.S. PATENT DOCUMENTS

| | | | | |
|---|---|---|---|---|
| 2011/0101601 | A1* | 5/2011 | Yoda | B65H 31/02<br>271/163 |
| 2013/0009360 | A1* | 1/2013 | Ma | G03G 15/6552<br>271/279 |

* cited by examiner

SHEET TRAY AND SHEET CONVEYING APPARATUS

CROSS REFERENCE TO RELATED APPLICATION

The present application claims priority from Japanese Patent Application No. 2016-016561 filed on Jan. 29, 2016 the disclosure of which is incorporated herein by reference in its entirety.

BACKGROUND

Field of the Invention

The present invention relates to a sheet tray configured to support a sheet, and a sheet conveying apparatus provided with a sheet tray configured to support a sheet to be fed to a main body of the sheet conveying apparatus.

Description of the Related Art

There is known a sheet tray having a configuration in which a three or more staged-tray including three or more trays is expanded and contracted. For example, there is known a feed tray capable of enlarging a supporting surface for supporting a sheet thereon by drawing (pulling out) a four-staged tray. This feed tray is provided with a lock mechanism for locking the trays at the respective stages so as to prevent a such a situation that a drawn state, wherein the tray(s) is (are) drawn, cannot be maintained due to natural falling of a tray which is arranged at an immediately above the stage of each of the trays by its own weight. Namely, in this feed tray, the locking is performed three times in a process of drawing the four staged-tray completely.

SUMMARY

In the above-described feed tray, in a process in which the rays are being drawn, the trays are engaged or locked with one another for a plurality of times until all the trays are completely drawn. Due to this, it is hard for a user to grasp whether or not a complete drawn state, in which all the trays are completely drawn, is achieved.

The present teaching has been made in view of the above-described situation, and an object of the present teaching is to provide a multiple-staged sheet tray in which the complete drawn state can be grasped easily.

According to an aspect of the present teaching, there is provided a sheet tray configured to support a sheet including:

a first tray including a first supporting surface configured to support the sheet;

a second tray including a second supporting surface configured to support the sheet, in a state that at least a portion of the second supporting surface is located on an opposite side in an orthogonal direction orthogonal to the first supporting surface, the second tray being supported by the first tray such that the second tray is slidably movable in a sliding direction, which is along the first supporting surface, between a first position and a second position, wherein the first position is a position at which the second supporting surface is overlapped with the first supporting surface, and the second position is a position at which the second supporting surface is overlapped with the first supporting surface and at which an overlapping area of the second supporting surface with respect to the first supporting surface is smaller than that at the first position; and a third tray including a third supporting surface configured to support the sheet, in a state that at least a portion of the third supporting surface is located on an opposite side in an orthogonal direction orthogonal to the second supporting surface, the third tray being supported by the second tray such that the third tray is slidably movable in the sliding direction between a third position and a fourth position, wherein the third position is a position at which the third supporting surface is overlapped with the second supporting surface, and the fourth position is a position at which the third supporting surface is overlapped with the second supporting surface and at which an overlapping area of the third supporting surface with respect to the second supporting surface is smaller than that at the third position, wherein the second tray includes a first engaging section configured to engage with the first tray at the second position;

the third tray includes a second engaging section configured to make contact with the second tray, in a drawing direction from the first position toward the second position, under a condition that the third tray is arranged at a fifth position located between the third and fourth positions, the second engaging section being configured to engage with the second tray at the fourth position;

the second engaging section is configured to be elastically deformable such that the second engaging section is movable in a releasing direction in which the contact between the second engaging section and the second tray is released; and the second tray and the third tray are configured to be movable integrally in the drawing direction in a state that the second engaging section makes contact with the second tray.

According to the above configuration, in a case that the third tray is moved in the drawing direction, the third tray is moved to the fifth position, and the second engaging section of the third tray makes contact with the second tray in the drawing direction. In a case that the third tray is drawn further in the drawing direction, the third tray and the second tray are moved integrally, that is, the third tray is moved together with the second tray in the drawing direction in the state that the second engaging section makes contact with the second tray. In a case that the second tray is moved up to the second position, the first engaging section of the second tray engages with the first tray. Further, in a case that the third tray is moved up to the fourth position, the second engaging section of the third tray engages with the second tray. In such a manner, the first tray, the second tray and the third tray engage with one another in a state that the second tray is moved to the second position and the third tray is moved to the fourth position.

According to the present teaching, the user can easily grasp the state that all the trays are completely drawn.

DESCRIPTION OF THE EMBODIMENT

Figure 1:
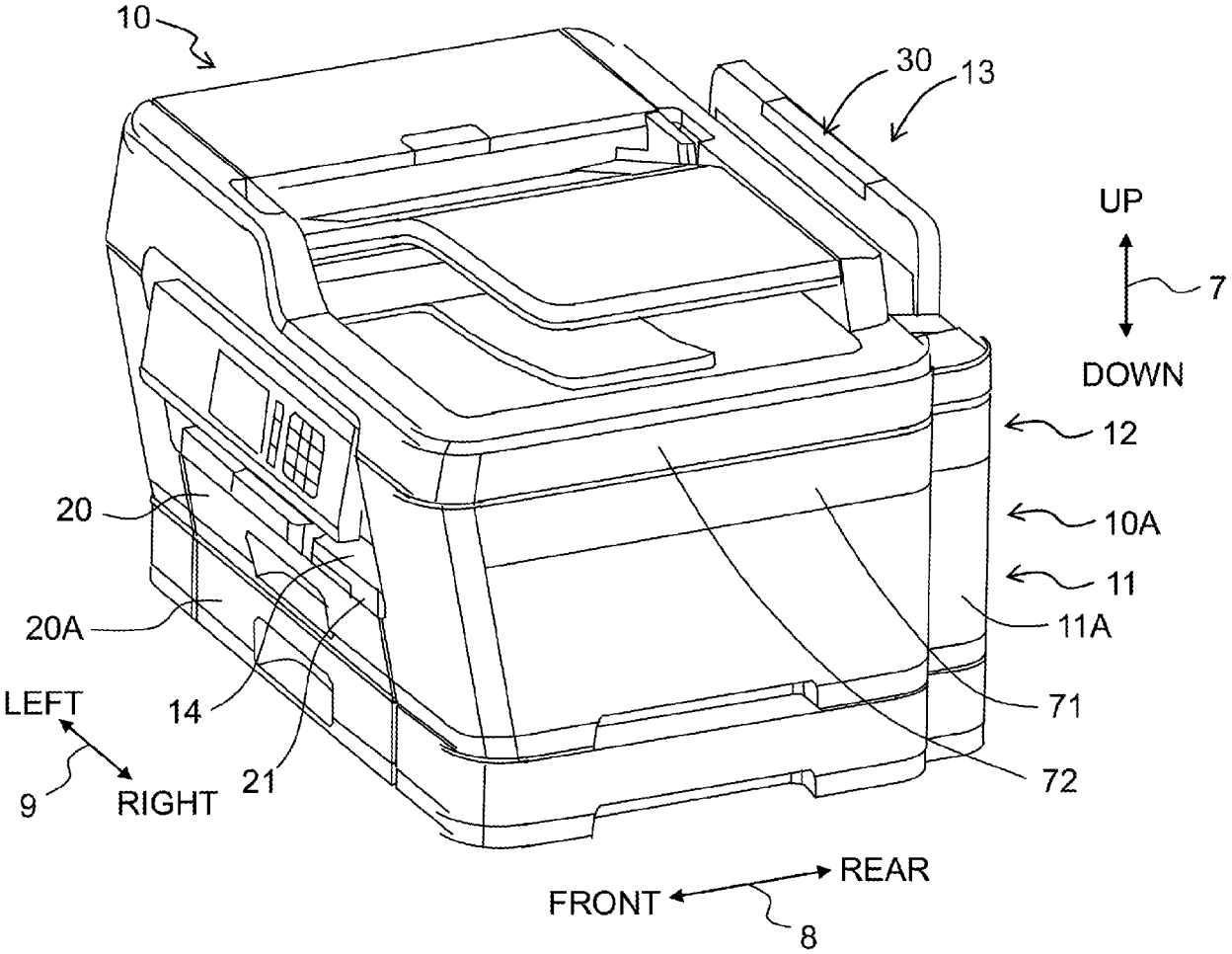
FIG. 1 is a perspective view of a multi-function peripheral 10.

In the following, an embodiment of the present teaching will be explained. It is needless to say that the embodiment to be explained below is merely an example of the present teaching, and that it is possible to appropriately change the embodiment of the present teaching without departing from or changing the gist and scope of the present teaching. In the following explanation, an up/down direction 7 is defined with a state that a multi-function peripheral 10 is usably placed (usable state; state depicted in FIG. 1), as the reference; a front/rear direction 8 is defined such that a surface on which an opening 14 of the multi-function peripheral 10 is provided is the frontward side (front side); and a left/right direction 9 is defined as viewing the multi-function peripheral 10 from the front side. In the following explanation of respective parts, components or elements of the multi-function peripheral 10, it is assumed that the up/down direction 7, the front/rear direction 8 and the left/right direction 9 are defined in a state that the respective parts, components or elements are incorporated or installed in the multi-function peripheral 10. Note that the multi-function peripheral 10 is provided with movable parts or components. With respect to those movable parts, the up/down direction 7, the front/rear direction 8 and the left/right direction 9 are defined with a regular state as depicted in FIG. 1, as the reference.

<Overall Structure of Multi-Function Peripheral 10>

As depicted in FIG. 1, the multi-function peripheral 10 (an example of a sheet conveying apparatus) is formed to have a substantially rectangular parallelepiped shape. The multi-function peripheral 10 has a main body unit 10A (hereinafter referred to also as the "body unit 10A", as appropriate). The body unit 10A is provided with a scanner section 12 which allows an image sensor to read an image recorded on a manuscript (original) such as a recording paper (paper sheet) so as to acquire image data of the read image. The body unit 10A is provided with a printer section 11 (an example of an apparatus main body, also referred to as the "apparatus body", as appropriate) which is arranged on a location below the scanner section 12 and which is configured to record an image on recording sheet 15 (an example of a sheet; recording paper or recording paper sheet 15) based on the above-described image data, etc. The multi-function peripheral 10 is provided with a MP tray 13 which is arranged at a rear portion of the body unit 10A ("MP" is an abbreviation of "Multi-Purpose"). The MP tray 13 has a tray main body 30 (an example of a sheet tray; hereinafter referred to also as the "tray body 30", as appropriate) which is configured to be rotatable or pivotable with respect to the body unit 10A.

<Printer Section 11>

The printer section 11 has a printer casing 11A in which a feed tray 20 is provided therein. The feed tray 20 A is configured to insertable and removal with respect to the printer casing 11A via the opening 14 in the front/rear direction 8 and configured to accommodate a recording sheet 15 therein. A lower feed tray 20A is arranged at a location below the feed tray 20. Since the function of the lower feed tray 20A is same as that of the feed tray 20, the inner configuration of the printer section 11 depicted in FIG. 2 only depicts the feed tray 20, while omitting the lower feed tray 20A.

Figure 2:
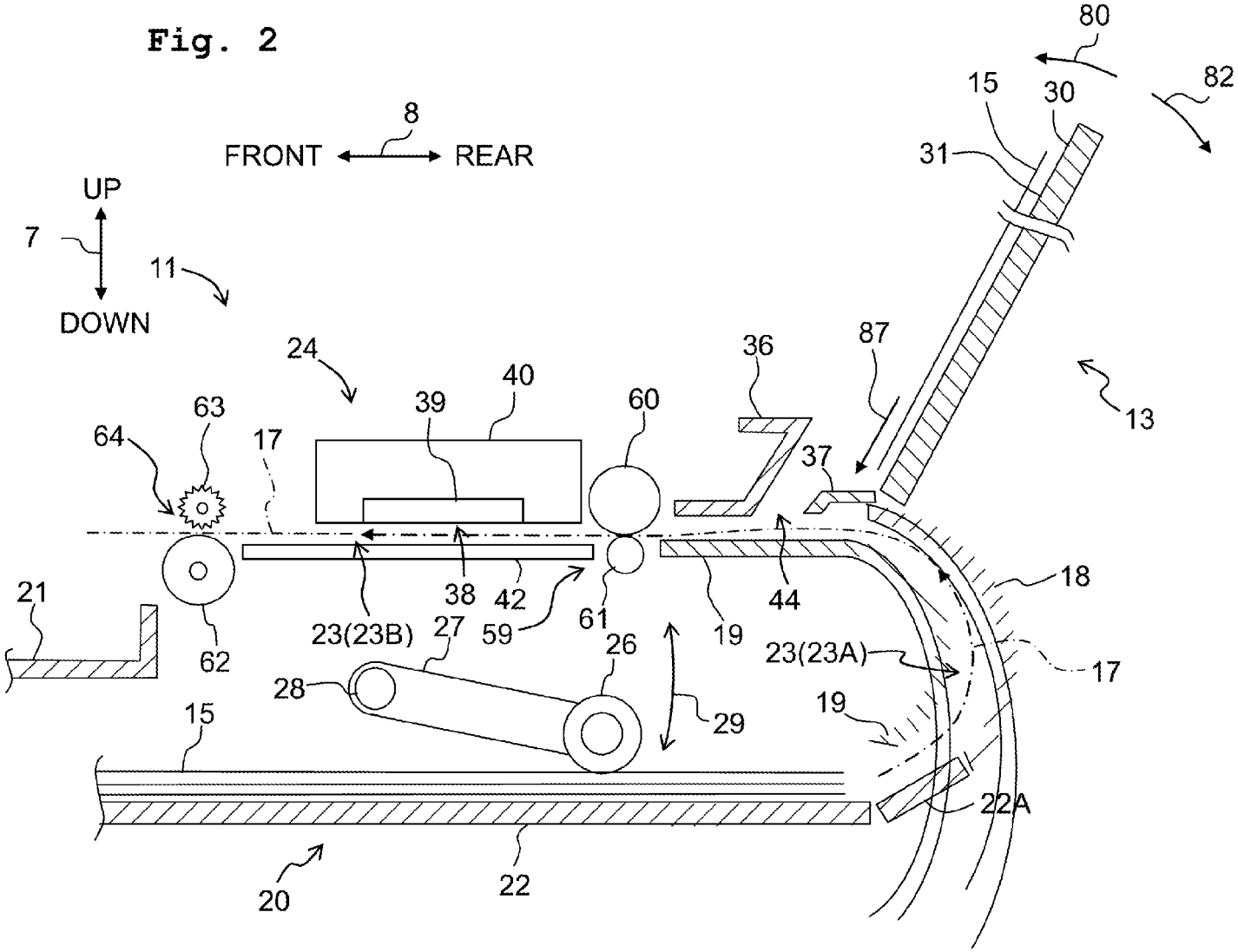
FIG. 2 is a vertical cross-sectional view schematically depicting the internal structure of a printer section 11.

As depicted in FIG. 2, a conveyance path 23 via which the recording sheet 15 is conveyed, and a recording section 24 configured to record an image, etc. on the recording sheet 15 conveyed in the conveyance path 23 are provide in the inside of the printer casing 11A in the printer section 11. Arrows 17 indicated in the conveyance path 23 indicate a conveyance direction in which the recording sheet 15 is conveyed. A conveying roller pair 59 is arranged in the conveyance path 23, on the upstream side in the conveyance direction 17 of the recording section 24. A discharging roller pair 64 is arranged in the conveyance path 23, on the downstream side in the conveyance direction 17 of the recording section 24.

A feeding roller 26 is arranged at a location above the feed tray 20 and below the recording section 24. The feeding roller 26 is axially supported at a forward end portion of a feeding arm 27. The feeding roller 26 is rotated by the driving force transmitted thereto from a feeding motor (not depicted in the drawings). The feeding arm 27 is rotated in directions indicated by a double-sided arrow 29, about a shaft 28 which is provided at a basal end portion thereof as the rotating center.

The recording sheet 15 having the image recorded thereon in the recording section 24 is discharged to a discharge ray 21 provided on the upper surface of the feed tray 20, and is supported by the discharge tray 21. The discharge tray 21 is supported by the feed tray 20.

<Conveyance Path 23>

As depicted in FIG. 2, the conveyance path 23 is extended from a rear end portion of the feed tray 20. The conveyance path 23 is provided with a curved portion 23A and a linear portion 23B. The curved portion 23A extends while being curved, with a rear side thereof as a curvature outer side and a front side thereof as a curvature inner side. The linear portion 23B is extended from an upper end portion of the curved portion 23A and extends frontwardly.

The curved portion 23A is defined by a first guide member 18 and a second guide member 19 facing each other with a predetermined spacing distance therebetween. The first guide member 18 defines the curvature outer side of the curved portion 23A. A guide plate 22A, having a non-illustrated separating section for preventing any overlapped feeding of the recording sheets 15, is arranged between the first guide member 18 and a bottom plate 22 constructing the base of the feed tray 20. The second guide member 19 defines the curvature inner side of the curved portion 23A. The linear portion 23B is defined by the recording section 24 and a platen 42 facing each other with a predetermined spacing distance therebetween at a position at which the recording section 24 is arranged. The first guide member 18 and the second guide member 19 are provided to extend in the left/right direction 9 that is a direction perpendicular to the sheet surface of FIG. 2.

The recording sheet 15 supported by the feed tray 20 is conveyed by the feeding roller 26 in the curved portion 23A so as to make an upward U-turn from a lower portion toward an upper portion of the curved portion 23A, and then reaches the conveying roller pair 59. The recording sheet 15 pinched by the conveying roller pair 59 is conveyed frontwardly in the linear portion 23B, with an image recording surface of the recording sheet 15 facing toward the recording section 24. The recording sheet 15 arrived at a location immediately below the recording section 24 is subjected to image recording by which an image, etc. is recorded on the image recording surface of the recording sheet 15 by the recording section 24. The recording sheet 15 having the image, etc. recorded thereon is conveyed frontwardly in the linear portion 23B and is discharged to the discharge tray 21. As described above, the recording sheet 15 is conveyed in the conveyance direction 17 indicated by dash-dot line arrows in FIG. 2.

<Bypass Route 44>

As depicted in FIG. 2, a bypass route 44 is provided as a route or a path for feeding the recording sheet 15 to a location, in the conveyance path 23, on the upstream side in the conveyance direction 17 of the conveying roller pair 59, without via the curved portion 23A. The bypass route 44 is composed of a route defined by a guide section 36 and a guide section 37, and the linear portion 23B of the conveyance path 23 in the inside of the printer casing 11A. The recording sheet 15 supported by a supporting surface 31 of the MP tray 13 is guided by the guide members 36 and 37, and a forward end portion of the recording sheet 15 (also referred to as an end portion in the feeding direction) makes contact with the conveying roller pair 59 (an example of a feeding section) to thereby subject the recording sheet 15 to the positioning. The positioned recording sheet 15 is fed in a feeding direction 87 and is conveyed in the linear portion 23B by the conveying roller pair 59, and the recording sheet 15 is further subjected to the image recording and has an image, etc., recorded thereon by the recording section 24. The recording sheet 15 having the image, etc. recorded thereon is conveyed by the discharging roller pair 64 and is discharged to the discharge tray 21. The specific of the guide section 36 will be described later on.

<Recording Section 24>

As depicted in FIG. 2, the recording section 24 is arranged at a location above the linear portion 23B and is provided with a carriage 40 and a recording head 38. The platen 42 is disposed at a location which is below the recording section 24 and at which the platen 42 faces the recording section 24. The plate 42 is a member configured to support, on an upper portion of the plate 42, the recording sheet 15 which is being conveyed in the linear portion 23B by the conveying roller pair 59.

The carriage 40 is configured to be movable in the left/right direction 9 by two guide rails (not depicted in the drawings) which are arranged with a spacing distance therebetween in the front/rear direction 8. The recording head 38 is mounted on the carriage 40. An ink is supplied from, for example, an ink cartridge (not depicted in the drawings) to the recording head 24. Nozzles 39 are formed in the lower surface of the recording head 38. In a state that the carriage 40 is moving in the left/right direction 9, the recording head 38 discharges or jets ink droplets of the ink toward the plate 42. With this, an image, etc. is recorded on the recording sheet 15 in a state that the recording sheet 15 is supported by the plate 42.

<Conveying Roller Pair 59>

The conveying roller pair 59 is provided with a conveyance roller 60 arranged at a location above the linear portion 23B and a pinch roller 61 arranged at a location below the linear portion 23B while facing the conveying roller 60.

<Discharging Roller Pair 64>

As depicted in FIG. 2, the discharging roller pair 64 is provided with a discharge roller 62 arranged at a location below the linear portion 23B and a spur 63 arranged at a location above the linear portion 23B while facing the discharging roller 63.

Each of the conveyance roller 60 and the discharge roller 62 is rotated by a driving force transmitted thereto from a conveyance motor (not shown). In a case that the conveyance roller 60 is rotated in a state that the recording sheet 15 is pinched by the conveying roller pair 59 (nip state), the recording paper 15 is conveyed by the conveying roller pair 59 in the conveyance direction 17. In a case that the discharge roller 62 is rotated in a state that the recording sheet 15 is pinched by the discharging roller pair 64, the recording paper 15 is conveyed by the discharging roller pair 64 in the conveyance direction 17.

Note that in this embodiment, the system by which the recording section 24 records the image, etc. on the recording sheet 15 is the ink-jet recording system. Note that, however, the recording system is not limited to the ink-jet recording system. The image recording system may be, for example, the electro-photographic system, etc.

<Scanner Section 12>

The scanner section 12 is configured as a so-called flat head scanner, and has a scanner main body 71 (also referred to as the "scanner body 71", as appropriate) disposed on the body unit 10A, and a manuscript cover 72 arranged on the scanner body 71, as depicted in FIG. 1. A platen glass (not depicted in the drawings) is provided on the upper surface of the scanner body 71. An image sensor (not depicted in the drawings) which is capable of optically reading an image of a manuscript or a document on the platen glass, is provided at the inside of the scanner body 71.

<MP Tray 13>

Figure 5:
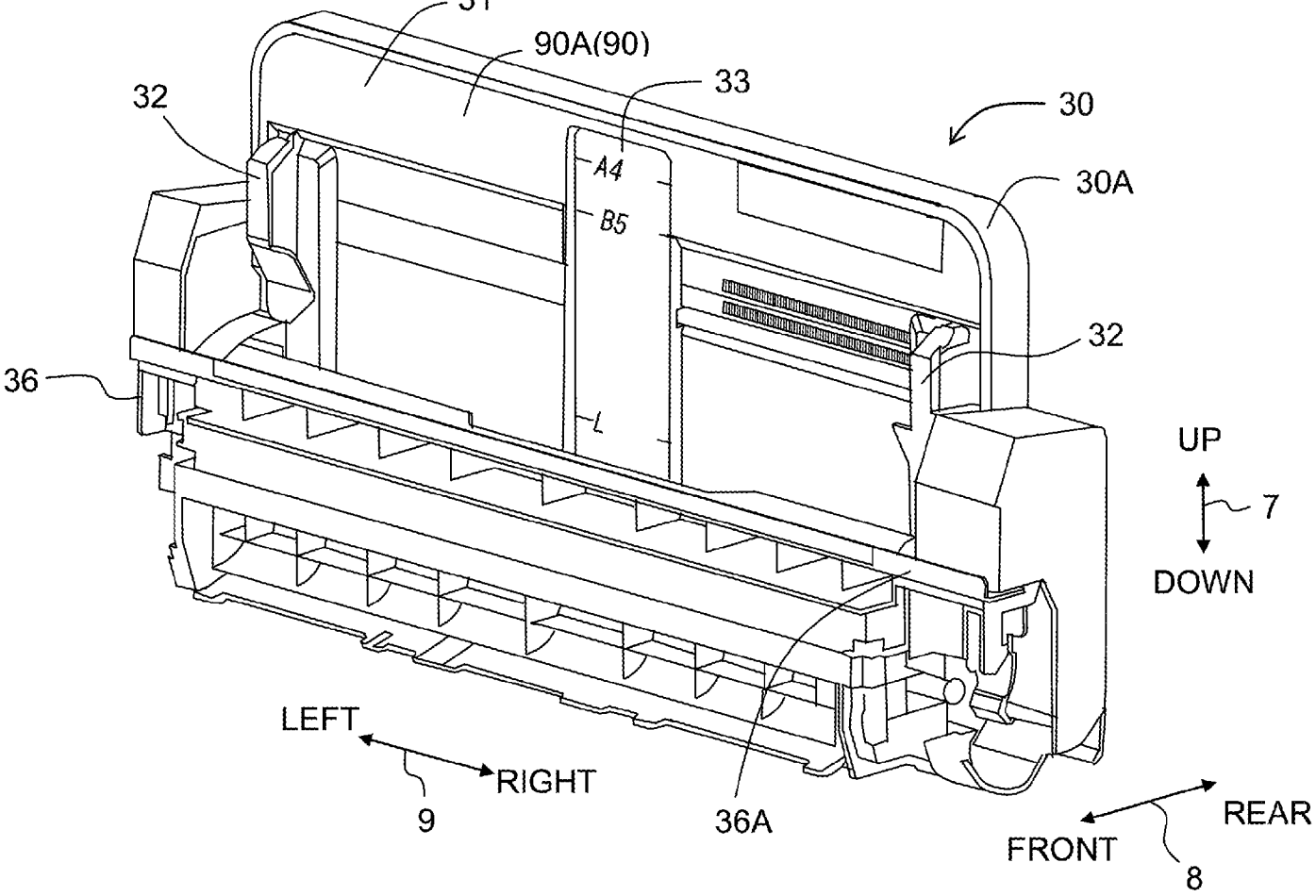
FIG. 5 is a perspective view depicting the tray body 30 which is in an erected state and in which the second tray 30B and the third tray 30C are each in the stored position.

As depicted in FIG. 2, the MP tray 13 has a function of supplying a recording sheet 15 to the conveyance path 23 via the bypass route 44. The MP tray 13 has the tray body 30 which is rotatably (pivotably) supported with respect to the body unit 10A, with a rotary axis line 35 (see FIG. 3) as the rotation center. The tray body 30 has the supporting surface 31 configured to support the recording sheet 15. The supporting surface 31 supports the recording sheet 15 to be fed to the multi-function peripheral 10. The tray body 30 is rotatable between an erected state depicted in FIG. 5 and an inclined state depicted in FIG. 3. In the erected state of the tray body 30, the supporting surface 31 is oriented frontward in a state that the supporting surface 31 is spreading or expanding along the up/down direction 7 and the left/right direction 9. In the inclined state of the tray body 30, the supporting surface 31 is in such a state that an upper end portion of the supporting surface 31 is away farther from the body unit 10A than in the erected state of the tray body 30. In FIG. 2, directions in which the tray body 30 is rotated are indicated by arrows 80 and 82.

In the following explanation of the MP tray 13, the respective parts or components of the MP tray 13 will be explained with reference to the respective directions regarding the tray body 30 in the erected state, namely the up/down direction 7, the front/rear direction 8 and the left/right direction 9.

<Tray Body 30>

Figure 3:
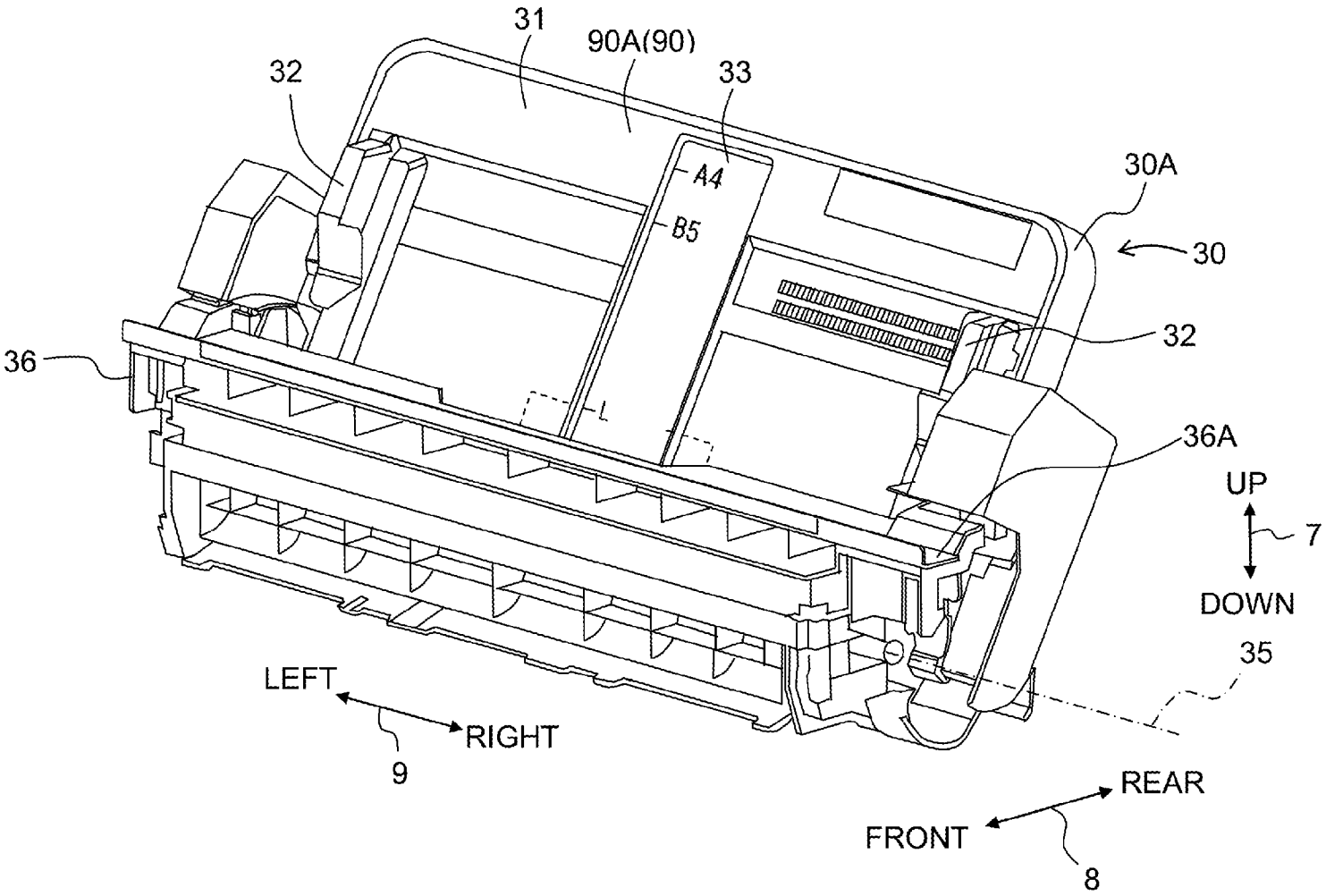
FIG. 3 is a perspective view depicting a tray body 30 which is in an inclined state and in which a second tray 30B and a third tray 30C are each in a stored position.
Figure 4:
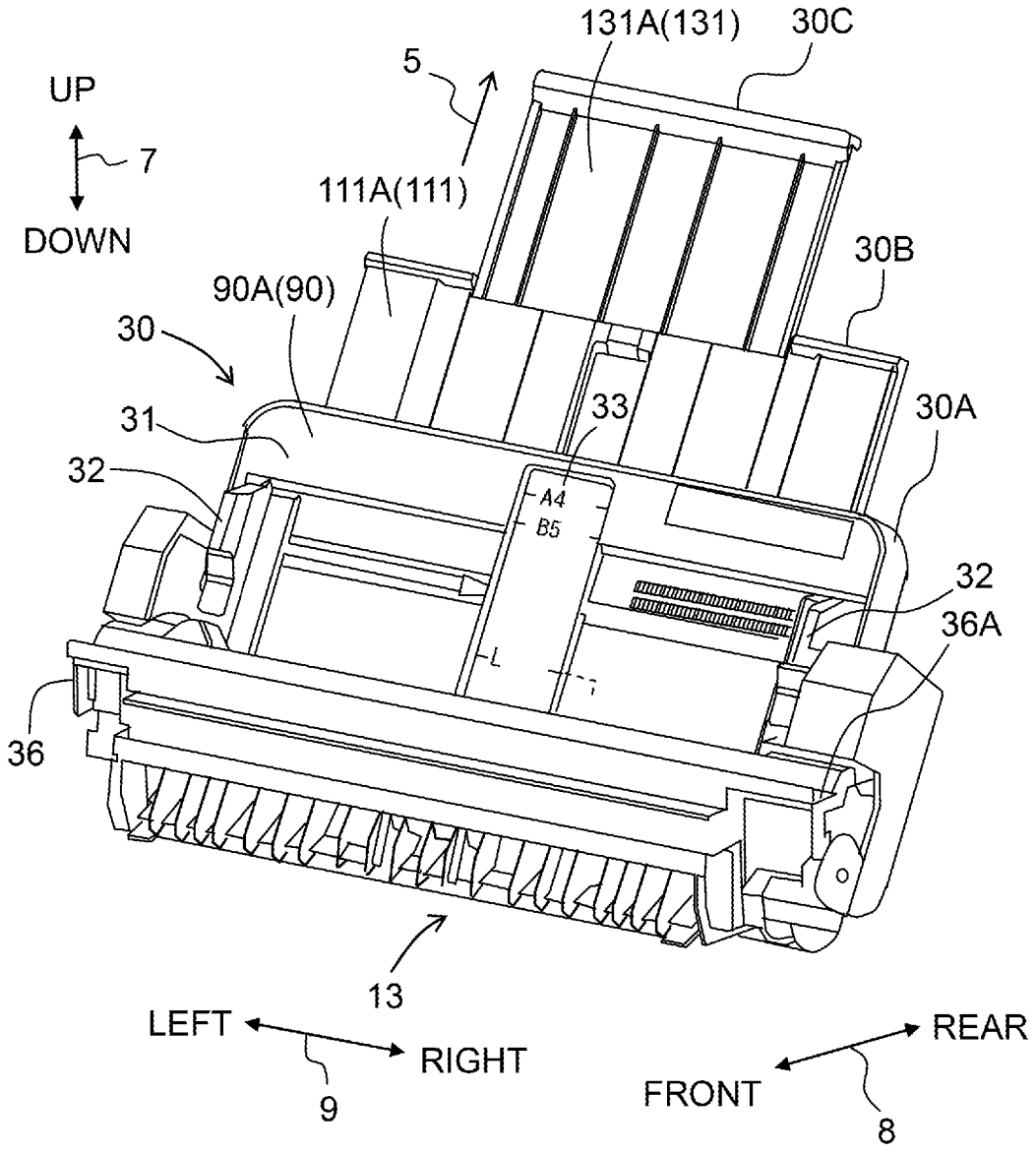
FIG. 4 is a perspective view depicting the tray body 30 which is in the inclined state and in which the second tray 30B and the third tray 30C are each in a drawn position.

As depicted in FIG. 4, the tray body 30 has a first tray 30A having a space therein (inner space; see FIGS. 6A and 6B); a second tray 30B which is configured to be storable in the inner space of the first tray 30A and to be drawnable from the inner space; and a third tray 30C which is configured to be storable in the inner space of the first tray 30A and to be drawnable from the inner space. It is possible to change the states of the second and third trays 30B and 30C from a stored state in which the second and third trays 30B and 30C are stored in the inner space of the first tray 30A (see FIG. 3) to a drawn state in which the second and third trays 30B and 30C are drawn (pulled out) from the inner space of the first tray 30A (see FIG. 4). With this, the tray body 30 and the supporting surface 31 are extended or elongated in a drawing direction 5 in which the second and third trays 30B and 30C are drawn.

In the following explanation of the tray body 30, the shape, etc., of the tray body 30 will be explained by using the respective directions regarding the tray body 30 in the erected state.

<Guide Section 36>

Figure 6B:
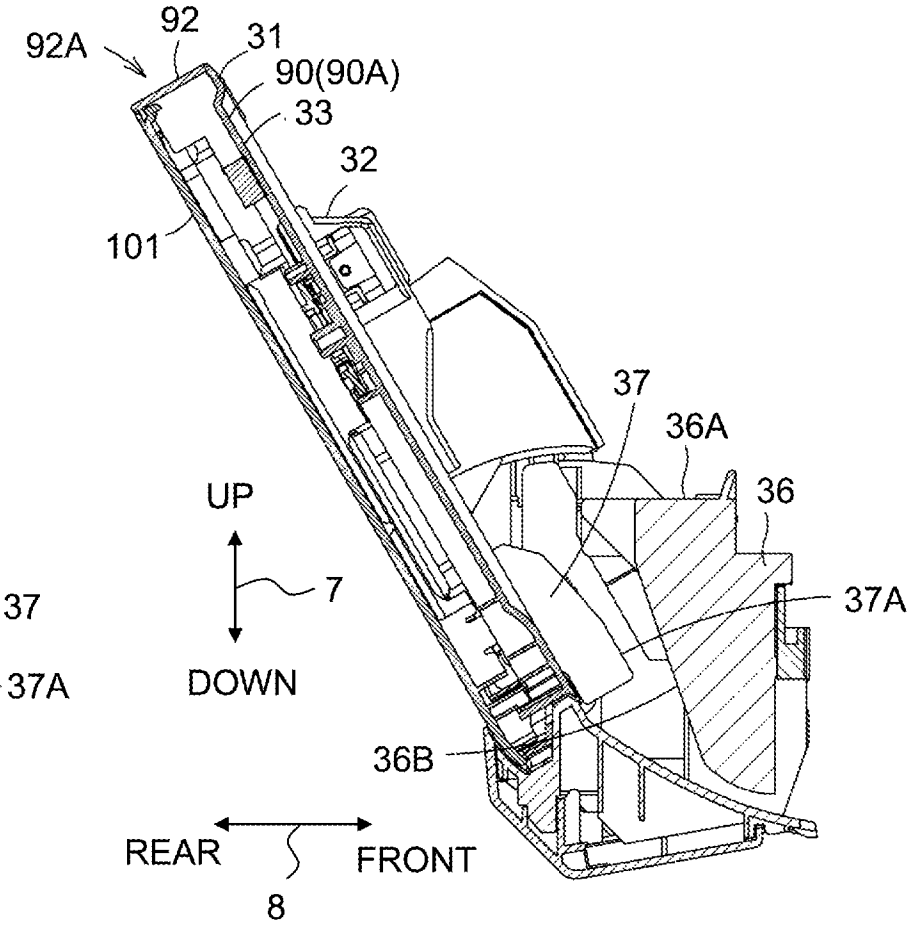
FIG. 6B is a vertical cross-sectional view at the center portion of the first tray 30A in the inclined state.
Figure 6A:
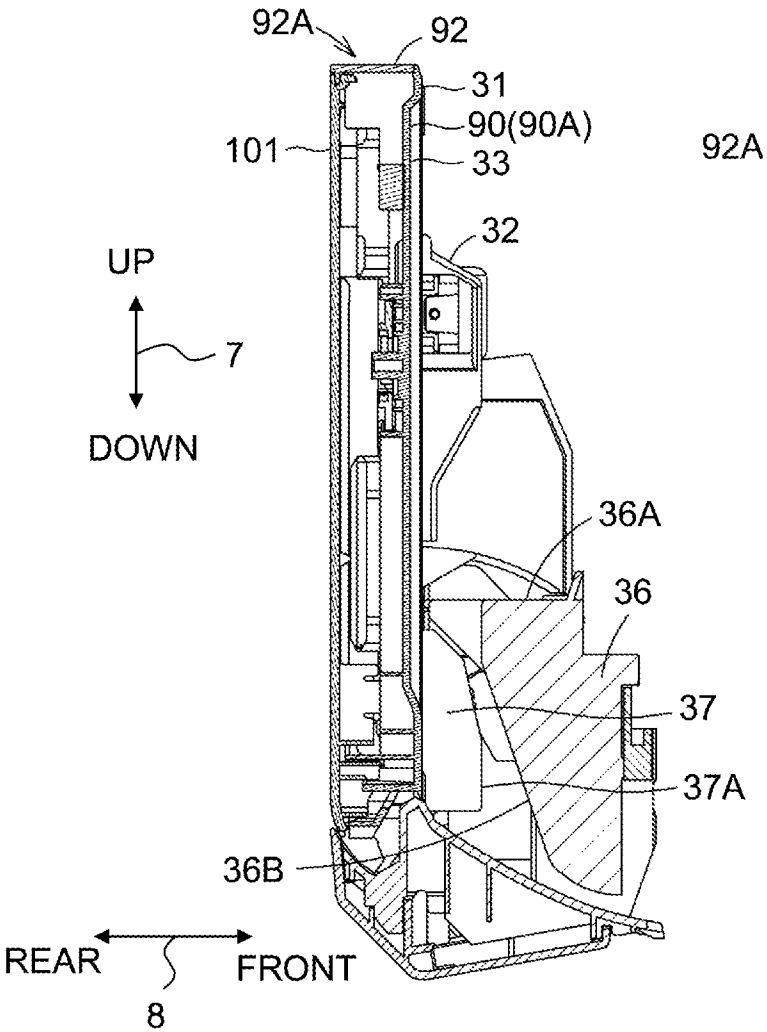
FIG. 6A is a vertical cross-sectional view at a center portion of the first tray 30A in the erected state.

As depicted in FIGS. 6A and 6B, the MP tray 13 is provided with the guide section 36. The guide section 36 is positioned at a location in front of a first supporting surface 90A (to be described later on) of the first tray 30A. The guide section 36 guides, to the bypass route 44, a recording sheet 15 which is fed while being supported by the first supporting surface 90A of the first tray 30A. The guide section 36 has an upper surface 36A and a guide surface 36B. A portion of the bypass route 44 is defined by the guide surface 36B of the guide section 36 and a guide surface 37A of the guide section 37 described below which are opposite to each other in the up/down direction 7.

The upper surface 36A is expanding along the front/rear direction 8 and the left/right direction 9 and faces (is oriented) upwardly. In the erected state of the tray body 30 as depicted in FIG. 6A, a rear end portion of the upper surface 36A is arranged closely to the first supporting surface 90A and covers an upper portion of the bypass route 44. With this, the guide section 36 functions as a lid of the bypass route 44. On the other hand, in the inclined state of the tray body 30 as depicted in FIG. 6B, a spacing distance or a gap between an upper end portion of the guide surface 36B and the first supporting surface 90A becomes large. With this, the spacing distance between the guide surface 36B of the guide section 36 and the guide surface 37A of the guide section 37 becomes large, thereby forming a portion of the bypass route 44.

The guide section 36 is formed with a cutout portion, at a central portion in the left/right direction 9 in the rear end portion of the upper surface 36A, such that the cutout portion has a shape recessing frontwardly. In conformity with this, a central portion in the left/right direction 9 in an upper end portion of the guide surface 36B is expanding substantially along the up/down direction 7 and left/right direction 9. With this, in a case that a recording sheet 15 having a small size (for example, an L-sized recording sheet 15 used in the photographic recording) is supported by the MP tray 13, a user can easily take out the recording sheet 15 from the MP tray 13.

<First Tray 30A>

Figure 7:
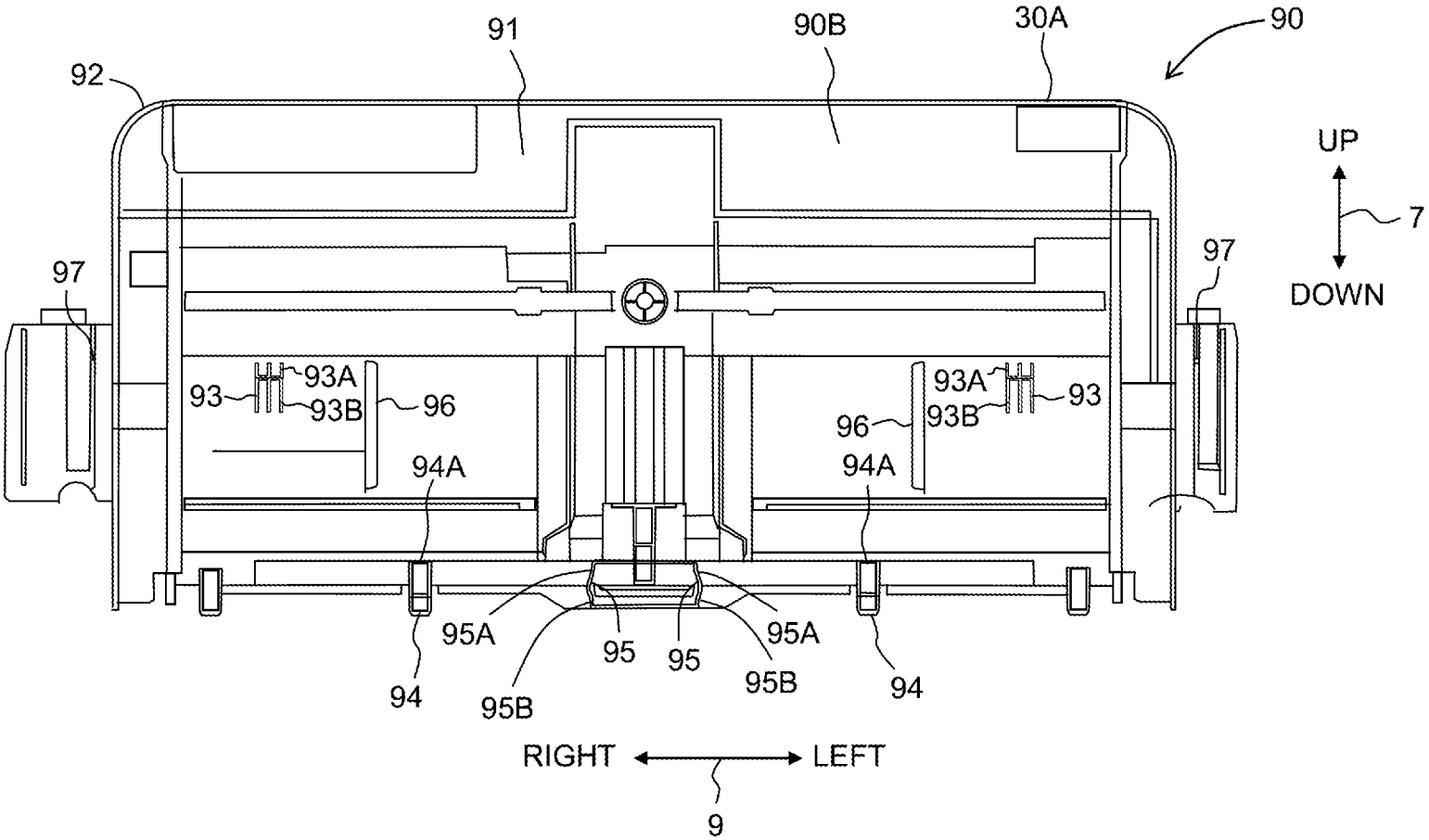
FIG. 7 is a plane view depicting a rear surface 90B of a first supporting plate 90 in the first tray 30A.
Figure 8:
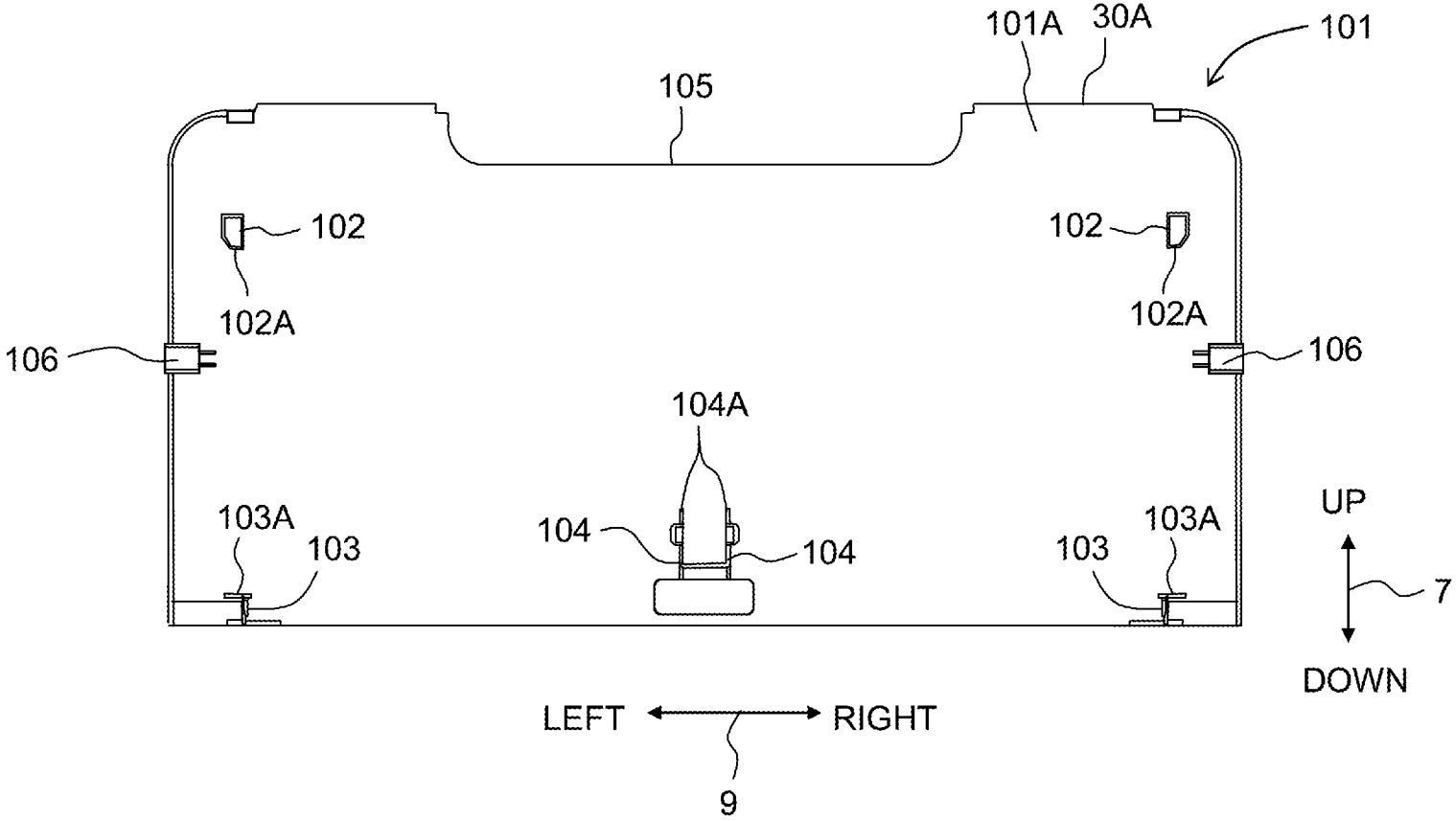
FIG. 8 is a plane view depicting a front surface 101A of a rear cover 101 in the first tray 30A.

As depicted in FIGS. 3 and 8, the first tray 30A has the first supporting plate 90 and a rear cover 101 (also see FIGS. 6A and 6B). The first supporting plate 90 has a plate portion 91 (see FIG. 7) which is a plate-shaped member expanding in the up/down direction 7 and the left/right direction 9, and an extended portion 92 (also see FIGS. 6A and 6B and FIG. 7) which is extended rearwardly from a peripheral edge portion in the up/down direction 7 and left/right direction 9 of the plate portion 91. The rear cover 101 is arranged on the rear side of the first supporting plate 90, with a spacing distance from the plate portion 91.

The plate portion 91 has a rectangular shape expanding along the up/down direction 7 and the left/right direction 9. The extended portion 92 has a cylindrical (tubular) shape extending in the front/rear direction 8. The rear cover 101 has a shape substantially same as that of the plate portion 91.

As depicted in FIGS. 6A and 6B, the extended portion 92 has a through hole 92A formed in an upper portion thereof while penetrating through the upper portion in the up/down direction 7. The through hole 92A is located at an upper end portion of the first tray 30A. The size in the left/right direction 9 of the through hole 92A is greater than the size in the left/right direction 9 of the second tray 30B.

<Side Guide 32>

As depicted in FIG. 3, a pair of side guides 32 are disposed in the first supporting surface 90A of the first tray 30, respectively at locations on the left and right sides relative to the center in the left/right direction 9 of the first supporting surface 90A. The side guides 32 extend parallel to the first supporting surface 90A and along the up/down direction 7, and are configured to movable in the first supporting surface 90A along the left/right direction 9. The side guides 32A are connected by a publicly known connecting mechanism such that when one of the side guides 32 is moved leftwardly, the other of the side guides 32 is moved rightwardly, and that one of the side guides 32 is moved rightwardly, the other of the side guides 32 is moved leftwardly. The side guides 32 are arranged respectively on the left and right sides, with a central recessed portion 33 (see FIG. 3; to be described later on) located on the central portion in the left/right direction 9 of the first tray 30A being interposed between the sides guides 32. By allowing surfaces, of the pair of side guides 32, facing each other to make contact with both end portions in the left/right direction of the recording sheet 15, respectively, the recording sheet 15 is positioned or aligned, with the center position in the left/right direction 9 in the first tray 30A as the reference.

<Central Recessed Portion 33>

As depicted in FIG. 3, the central recessed portion 33 is formed in the first supporting surface 90A. The L-size which is used for the photographic recording is the smallest size usable in the multi-function peripheral 10. The lower end of the central recessed portion 33 is located at a position lower than an upper end of a recording sheet 15 having the L-size and placed in the portrait (vertical) orientation. The upper end of the central recessed portion 33 is located at a position higher than an upper end of a recording sheet 15 having A4 size of Japanese Industrial Standard and supportable by the MP tray 30, and placed in the landscape (horizontal) orientation, in a state that the second tray 30B and the third tray 30C are not drawn.

The central recessed portion 33 is formed to be recessed rearwardly in the first supporting surface 90A, as depicted in FIGS. 6A and 6B. Accordingly, in a state that the recording sheet 15 is supported on the first supporting surface 90A, a spacing distance or a gap is generated between a surface, of the recording sheet 15 facing the first supporting surface 90A and the central recessed portion 33. When the recording sheet 15 is supported by the MP tray 13, the recording sheet 15 is placed such that the forward end portion (end portion in the feeding direction) of the recording sheet 15 makes contact with the conveying roller pair 59. Therefore, when a L-sized recording sheet 15 is placed in the MP tray 13, the upper end of the L-sized recording sheet 15 is located at a low position as indicated by broken lines in FIG. 3. Also in this case, the spacing distance is generated between the upper end portion of the L-sized recording sheet 15 and the central recessed portion 33, and thus a user can easily take out the L-sized recording sheet 15 supported by the MP tray 13.

<First Supporting Plate 90>

As depicted in FIG. 3, the first supporting plate 90 constructing the first tray 30A has the first supporting surface 90A expanding along the up/down direction 7 and the left/right direction 9 while facing frontwardly. The first supporting surface 90A forms the supporting surface 31 in a state that the second tray 30B and the third tray 30C are stored in the first tray 30A in the tray body 30 (see FIG. 3). Further, the first supporting surface 90A forms a portion of the supporting surface 31 in a state that the second tray 30B and the third tray 30C are drawn from the first tray 30A in the tray body 30 (see FIG. 4).

As depicted in FIG. 7, the first supporting plate 90 has a rear surface 90B (an example of a projection supporting surface) expanding along the up/down direction 7 and the left/right direction 9 while facing rearwardly (the direction toward the front side of the sheet surface in FIG. 7). The rear surface 90B is provided with a pair of left and right projections 93, a pair of left and right projection 94, a pair of left and right projections 95, a pair of left and right guide rails 96. The projections 93, 94 and 95 and the guide rails 96 are integrally formed with the first supporting plate 90. The first supporting plate 90 is formed, for example, of a resin.

The projections 95 are projected rearwardly from a lower end portion in the rear surface 90B of the first supporting plate 90. The projections 95 each have a shape in which a central portion thereof in the up/down direction 7 is raised in a mountain-like shape projecting outwardly in the left/right direction 9. Each of the projections 95 has an upwardly inclined surface 95A which is inclined downwardly from the upper end of the projection 95 and outwardly in the left/right direction 9 and which faces upwardly, and a downwardly inclined surface 95B which is inclined upwardly from the lower end of the projection 95 and outwardly in the left/right direction 9 and which faces downwardly. The projections 95 are configured to correspond to engaging sections 133 in a third supporting plate 131 of the third tray 30C (to be described later on). Each of the projections 95 is located at a position at which at least a portion of each of the projections 95 is overlapped with one of the engaging sections 133 in the third supporting surface 131 of the third tray 30C in the front/rear direction 8 and the left/right direction 9.

The projections 94 are projected rearwardly from a lower end portion in the rear surface 90B of the first supporting plate 90. The projections 94 are each formed to have a cylindrical shape or a tubular shape. Each of the projections 94 has a square cylindrical shape extending in the front/rear direction 8. The projections 94 are located at the outer side in the left/right direction 9 relative to the projections 95. Each of the projections 94 has a contact surface 94A expanding in the front/rear direction 8 and the left/right direction 9 while facing upwardly. The projections 94 are configured to correspond to second cutout portions 114 in a second supporting plate 111 of the second tray 30B (to be described later on). Each of the projections 94 is located at a position at which at least a portion of each of the projections 95 is overlapped with one of the second cutout portions 114 in the second supporting surface 111 of the second tray 30B in the front/rear direction 8 and the left/right direction 9.

The guide rails 96 are projecting rearwardly from a central portion in the up/down direction 7 in the rear surface 90B of the first supporting plate 90, while extending in the up/down direction 7. The guide rails 96 are located at the outer side in the left/right direction 9 relative to the projections 94. Each of the guide rails 96 is projected rearwardly, then is bent toward the inner side in the left/right direction 9, and is extending in the up/down direction 7. Each of the guide rails 96 has a sliding surface (not depicted in the drawings) which faces frontwardly and extends along the up/down direction 7 and the front/rear direction 8. The guide rails 96 are configured to correspond to guide rails 119 in the second supporting plate 111 of the second tray 30B (to be described later on). Each of the guide rails 96 is located at a position at which at least a portion of each of the guide rails 96 is overlapped with one of the guide rails 119 in the second supporting surface 111 of the second tray 30B in the front/rear direction 8 and the left/right direction 9. In a case that each of the guide rails 119 is allowed to enter a location in front of the sliding surface of one of the guide rails 96 from the inner side in the left-right direction 9, the guide rails 96 and the guide rails 119 become slidably movable with respect to each other in the up/down direction 7.

As depicted in FIG. 7 (also see FIG. 15B), the projections 93 (an example of a second projection) are projected rearwardly from a central portion in the up/down direction 7 in the rear surface 90B of the first supporting plate 90. Each of the projections 93 is formed as three ribs extending in the up/down direction 7. The projections 93 are located at the outer side in the left/right direction 9 relative to the guide rails 96. Each of the projections 93 has an upwardly inclined surface 93A which is inclined downwardly (in the down direction) and rearwardly from the upper end of the projection 93 and which faces upwardly (an example of an inclined surface), and a downwardly inclined surface 93B which is inclined upwardly (in the up direction) and rearwardly from the lower end of the projection 95 and which faces downwardly (also see FIG. 15B). The projections 93 are configured to correspond to engaging sections 116 in the second supporting plate 111 of the second tray 30B (to be described later on). Each of the projections 93 is located at a position at which at least a portion of each of the projections 93 is overlapped with one of the engaging sections 116 in the second supporting surface 111 of the second tray 30B in the front/rear direction 8 and the left/right direction 9.

<Rear Cover 101>

As depicted in FIG. 8, the rear cover 101 (an example of a cover) has a front surface 101A which faces frontwardly and expands entirely in the rear cover 101 along the up/down direction 7 and the left/right direction 9. The front surface 101A is provided with a pair of left and right projections 102, a pair of left and right projection 103, and a pair of left and right projections 104, a pair of left and right projection 106. The projections 102, 103, 104 and 106 are integrally formed with the rear cover 101. The rear cover 101 is formed, for example, of a resin.

The projections 102 are projected frontwardly from a upper end portion which also forms end portions in the left/right direction 9 in the front surface 101A of the rear cover 101. The projections 102 each have a cylindrical shape. Each of the projections 102 has a contact surface 102A expanding in the front/rear direction 8 and the left/right direction 9 while facing downwardly. The projections 102 are configured to correspond to upper contact surfaces 117A of extended portions 117 in the second supporting plate 111 of the second tray 30B (to be described later on). Each of the projections 102 is located at a position at which at least a portion of each of the projections 102 is overlapped with the upper contact surface 117A of one of the extended portions 117 in the second supporting plate 111 of the second tray 30B in the front/rear direction 8 and the left/right direction 9.

The projections 103 are projected frontwardly from a lower end portion which also forms an end portion in the left/right direction 9 in the front surface 101A of the rear cover 101. Each of the projections 103 is formed as a rib which is H-shaped as seen from the front/rear direction 8. Each of the projections 103 has a contact surface 103A expanding in the front/rear direction 8 and the left/right direction 9 while facing upwardly. The projections 103 are configured to correspond to lower contact surfaces 117B of the extended portions 117 in the second supporting plate 111 of the second tray 30B (to be described later on). Each of the projections 103 is located at a position at which at least a portion of each of the projections 103 is overlapped with the lower contact surface 117B of one of the extended portions 117 in the second supporting plate 111 of the second tray 30B in the front/rear direction 8 and the left/right direction 9.

The projections 104 are projected frontwardly from a lower end portion which also forms a central portion in the left/right direction 9 in the front surface 101A of the rear cover 101. Each of the projections 104 is a rib extending in the up/down direction 7. Each of the projections 104 has a contact surface 104A expanding in the front/rear direction 8 and the left/right direction 9 while facing upwardly. The projections 104 are configured to correspond to first cutout portions 115 in the second supporting plate 111 of the second tray 30B (to be described later on). Each of the projections 104 is located at a position at which at least a portion of each of the projections 104 is overlapped with one of the cutout portions 115 in the second supporting plate 111 of the second tray 30B in the front/rear direction 8 and the left/right direction 9.

The projections 106 are projected frontwardly from outer end portions in the left/right direction 9 which also form a central portion in the up/down direction 7 in the front surface 101A of the rear cover 101. Each of the projections 106 is formed to have a cubic shape. The projections 106 are located at the outer side in the left/right direction 9 relative to the projections 103. Each of the projections 106 has a threaded hole (not depicted in the drawings) recessed inwardly from the outer surface of the projection 96 in the left/right direction 9. The position in the left/right direction 9 of the outer surface of each of the projections 96 corresponds to an inner surface in the left/right direction 9 in the extended portion 92 of the first supporting plate 90. The position of the threaded hole of each of the projections 106 corresponds to one of through holes 97 in the extended portion 92 of the first supporting plate 90.

The rear cover 101 has a cutout portion 105 recessed downwardly from the upper edge of the rear cover 101 at a central portion in the left/right direction 9 of the rear cover 101. The cutout 105 has a rectangular shape elongated in the left/right direction 9. The cutout portion 105 is located at a location above the projections 104. Further, the cutout portion 105 is located at the inner side in the left/right direction 9 relative to the projections 103. The width in the left/right direction 9 of the cutout portion 105 is substantially same as the width in the left/right direction 9 of the third tray 30 (to be described later on).

<Second Tray 30B>

Figure 9:
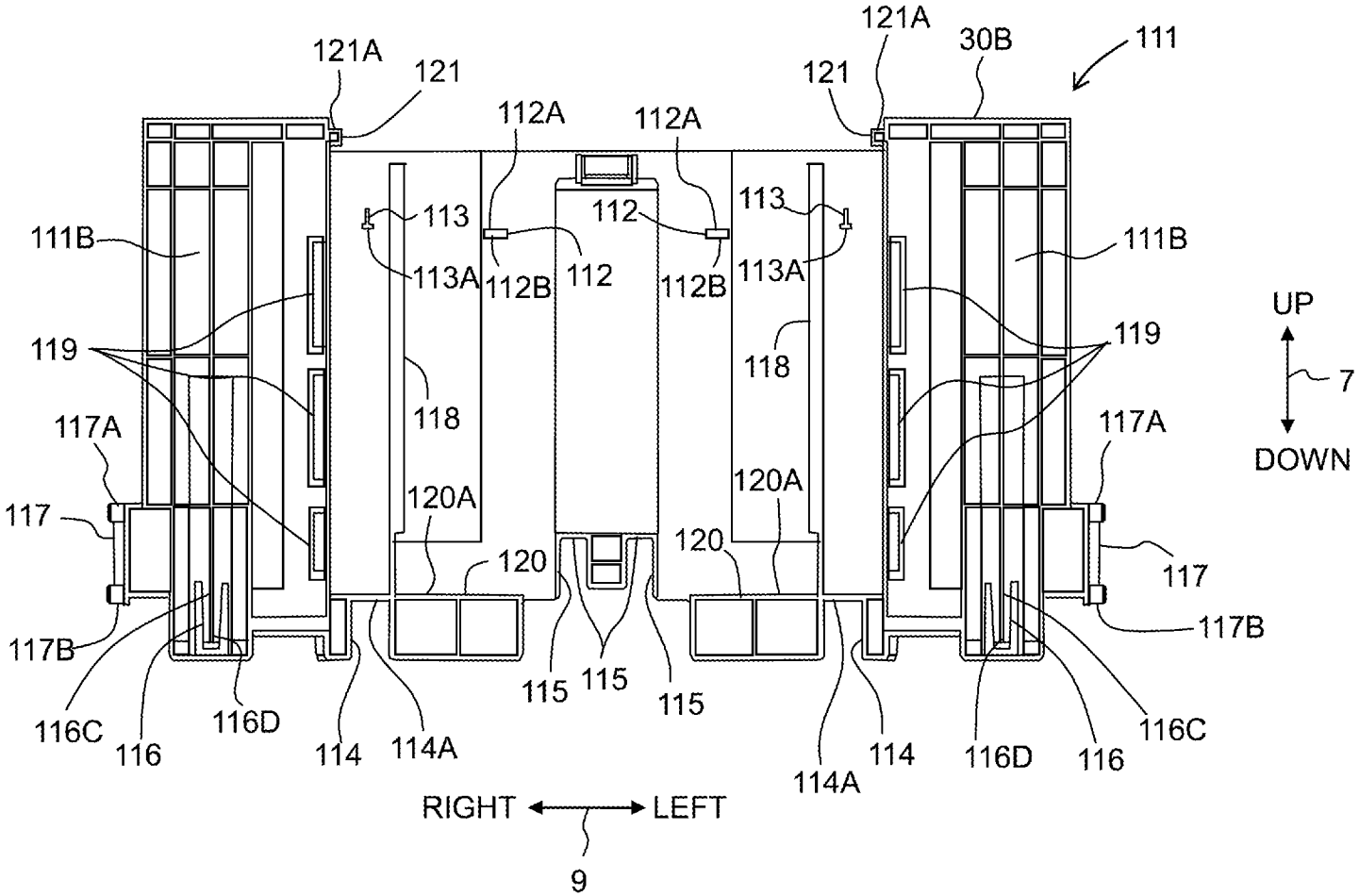
FIG. 9 is a plane view depicting a rear surface 111B of a second supporting plate 111 in the second tray 30B.

As depicted in FIG. 9, the second tray 30B has the second supporting plate 111 which is a plate-shaped member expanding along the up/down direction 7 and the left/right direction 9.

The second supporting plate 111 has a second supporting surface 111A (also see FIG. 4) expanding entirely in the second supporting plate 111 along the up/down direction 7 and the left/right direction 9, while facing frontwardly, and a rear surface 111B expanding along the up/down direction 7 and the left/right direction 9, while facing rearwardly.

The rear surface 111B is provided with a pair of left and right projections 112, a pair of left and right projection 113, a pair of left and right second cutout portions 114, a pair of left and right first cutout portions 115, a pair of left and right engaging sections 116, a pair of left and right extended portions 117, a pair of left and right guide rails 118, a pair of left and right guide rails 119, a pair of left and right projections 120, and a pair of left and right projections 121. The projections 112, the projections 113, the second cutout portions 114, the first cutout portions 115, the engaging sections 116, the extended portions 117, the guide rails 118, the guide rails 119, the projections 120 and the projections 121 are integrally formed with the second supporting plate 111. The second supporting plate 111 is formed, for example, of a resin.

The first cutout portions 115 are recessed upwardly from a lower end edge of the second supporting plate 111 at a central portion in the left/right direction 9 of the second supporting plate 111. Each of the first cutout portions 115 has a rectangular shape. Each of the first cutout portions 115 has a contact surface 115A expanding in the front/rear direction 8 and the left/right direction 9 while facing downwardly. The first cutout portions 115 are configured to correspond to the projections 104 in the rear cover 101 of the first tray 30A. Each of the first cutout portions 115 is located at a position at which at least a portion of each of the first cutout portions 115 is overlapped with one of the projections 104 in the rear cover 101 of the first tray 30A in the front/rear direction 8 and the left/right direction 9.

The projections 112 are projected rearwardly from an upper end portion in the rear surface 111B of the second supporting plate 111. Each of the projections 112 is a rib extending in the left/right direction 9. The projections 112 are located at the outer side in the left/right direction 9 relative to the first cutout portions 115. Each of the projections 112 has an upper surface 112A which is expanding in the front/rear direction 8 and the left/right direction 9 and which faces upwardly, and a lower surface 112B which is expanding in the front/rear direction 8 and the left/right direction 9 and which faces downwardly. The projections 112 are configured to correspond to engaging sections 134 in the third supporting plate 131 of the third tray 30C (to be described later on). Each of the projections 112 is located at a position at which at least a portion of each of the projections 112 is overlapped with one of the engaging sections 134 in the third supporting plate 131 of the third tray 30C in the front/rear direction 8 and the left/right direction 9.

The projections 120 are projected rearwardly from a lower end portion in the rear surface 111B of the second supporting plate 111. The projections 120 each have a cylindrical (tubular) shape. The projections 120 are located in the left/right direction 9 at positions which are substantially same as those of the projections 112, respectively. Each of the projections 120 has a contact surface 120A expanding in the front/rear direction 8 and the left/right direction 9 while facing upwardly. The projections 120 are configured to correspond to contact walls 137 in the third supporting plate 131 of the third tray 30C (to be described later on). Each of the projections 120 is located at a position at which at least a portion of each of the projections 120 is overlapped with one of the contact walls 137 in the third supporting plate 131 of the third tray 30C in the front/rear direction 8 and the left/right direction 9.

The guide rails 118 are projecting rearwardly from substantially the entire area in the up/down direction 7 in the rear surface 111B of the second supporting plate 111, while extending in the up/down direction 7. The guide rails 118 are located at substantially same positions as the outer edges in the left/right direction 9 of the projections 120. Each of the guide rails 118 is projected rearwardly, then is bent toward the inner side in the left/right direction 9, and is extending in the up/down direction 7. Each of the guide rails 118 has a sliding surface (not depicted in the drawings) which faces frontwardly and extends along the up/down direction 7 and the front/rear direction 8. The guide rails 118 are configured to correspond to guide rails 135 in the third supporting plate 131 of the third tray 30C (to be described later on). Each of the guide rails 118 is located at a position at which at least a portion of each of the guide rails 118 is overlapped with one of the guide rails 135 in the third supporting surface 131 of the third tray 30C in the front/rear direction 8 and the left/right direction 9. In a case that each of the guide rails 135 is allowed to enter a location in front of the sliding surface of one of the guide rails 118 from the inner side in the left-right direction 9, the guide rails 118 and the guide rails 135 become slidably movable with respect to each other in the up/down direction 7.

The projections 113 (an example of a first projection) are projected rearwardly from an upper end portion in the rear surface 111B of the second supporting plate 111. Each of the projections 113 is a rib having a T-shape. The projections 113 are located at the outer side in the left/right direction 9 relative to the guide rails 118. Each of the projections 113 has a contact surface 113A which is expanding in the front/rear direction 8 and the left/right direction 9 and which faces downwardly. The projections 113 are configured to correspond to projections 132 in the third supporting plate 131 of the third tray 30C (to be described later on). Each of the projections 113 is located at a position at which at least a portion of each of the projections 113 is overlapped with one of the projections 132 in the third supporting surface 131 of the third tray 30C in the front/rear direction 8 and the left/right direction 9.

The second cutout portions 114 are recessed upwardly from the lower end edge of the second supporting plate 111. Each of the second cutout portions 114 has a rectangular shape. The second cutout portions 114 are arranged at positions which are substantially same in the left/right direction 9 relative to the projections 113. Each of the second cutout portions 114 has a contact surface 114A expanding in the front/rear direction 8 and the left/right direction 9 while facing downwardly. The second cutout portions 114 are configured to correspond to the projections 94 in the first supporting plate 90 of the first tray 30A. Each of the second cutout portions 114 is located at a position at which at least a portion of each of the second cutout portion 114 is overlapped with one of the projections 94 in the first supporting plate 90 of the first tray 30A in the front/rear direction 8 and the left/right direction 9.

The projections 121 are projected from the upper end portion of the second supporting plate 111, respectively toward the inner sides in the left/right direction 9. Each of the projections 121 is formed to have a cubic shape. The projections 121 are located at the outer side in the left/right direction 9 relative to the second cutout portions 114. Each of the projections 121 has a contact surface 121A which is expanding in the front/rear direction 8 and the left/right direction 9 and which faces upwardly. The projections 121 are configured to correspond to an operation section 136 in the third supporting plate 131 of the third tray 30C (to be described later on). Each of the projections 121 is located at a position at which at least a portion of each of the projections 113 is overlapped with the operating section 136 in the third supporting surface 131 of the third tray 30C in the front/rear direction 8 and the left/right direction 9.

The guide rails 119 are projecting frontwardly from a central portion in the up/down direction 7 in the second supporting surface 111A of the second supporting plate 111, while extending in the up/down direction 7. The guide rails 119 are located at the outer side in the left/right direction 9 relative to the second cutout portions 114. Each of the guide rails 119 is projected frontwardly, then is bent toward the outer side in the left/right direction 9, and is extending in the up/down direction 7. Each of the guide rails 119 has a sliding surface 119A (see FIG. 11) which faces rearwardly and extends along the up/down direction 7 and the front/rear direction 8. The guide rails 119 are configured to correspond to the guide rails 96 in the first supporting plate 90 of the first tray 30A. Each of the guide rails 119 is located at a position at which at least a portion of each of the guide rails 119 is overlapped with one of the guide rails 96 in the first supporting plate 90 of the first tray 30A in the front/rear direction 8 and the left/right direction 9. In a case that each of the guide rails 96 is allowed to enter a location behind (on the rear side of) the sliding surface 119A of one of the guide rails 119 from the outer side in the left-right direction 9, the guide rails 119 and the guide rails 96 become slidably movable with respect to each other in the up/down direction 7.

Figure 15A:
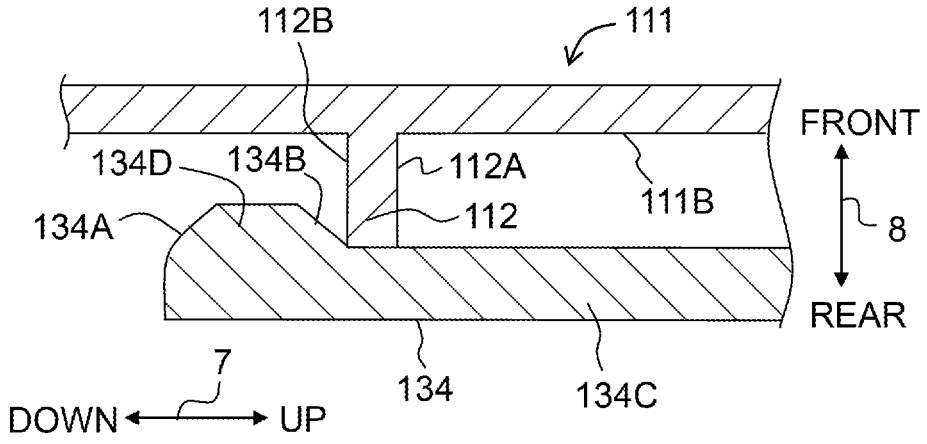
FIG. 15A is a cross-sectional view depicting a state that an engaging section 134 makes contact with a projection 112.
Figure 15B:
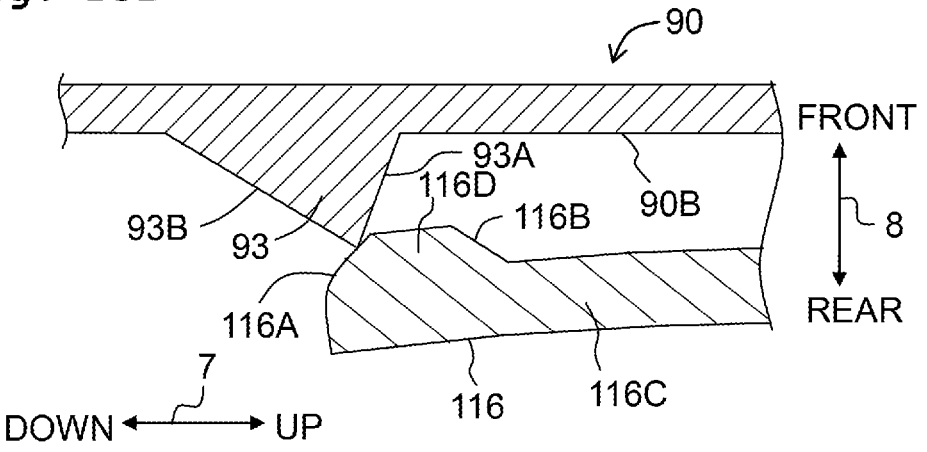
FIG. 15B is a cross-sectional view depicting a state that an engaging section 116 engages with a projection 93.

The engaging sections 116 (an example of a first engaging section) are located at a lower end portion of the second supporting plate 111. The engaging sections 116 are located at the outer side in the left/right direction 9 relative to the guide rails 119. As depicted in FIG. 15B, each of the engaging sections 116 has an elastic portion 116C configured to be elastically deformable and a projecting portion 116D which projects frontwardly at a lower end portion of the elastic portion 116C. The projecting portion 116D has a downwardly inclined surface 116A which is inclined frontwardly and upwardly (in the up direction) from the lower end of the projecting portion 116D and which faces (is oriented) downwardly, and an upwardly inclined surface 116B which is inclined frontwardly and downwardly (in the down direction) from the upper end of the projecting portion 116D and which faces (is oriented) upwardly. The downwardly inclined surface 116A and the upwardly inclined surface 116B are located in front of the second supporting surface 111A. Each of the engaging sections 116 is formed such that the projecting portion 116D is movable in the front/rear direction 8 by the elastic deformation of the elastic portion 116C. In other words, Each of the engaging sections 116 is formed such that the elastic portion 116C is elastically deformed to thereby allow the projecting portion 116D to be movable in the front/rear direction 8. The engaging sections 116 are configured to correspond to the projections 93 in the first supporting plate 90 of the first tray 30A. Each of the engaging sections 116 is located at a position at which at least a portion of each of the engaging sections 116 is overlapped with one of the projections 93 in the first supporting surface 90 of the first tray 30A in the front/rear direction 8 and the left/right direction 9.

The extended portions 117 (an example of a third projection) are projected outwardly in the left/right direction 9 from a lower end portion of the second supporting plate 111. The extended portion 117 each have a rectangular planar shape. Each of the extended portions 117 has an upper contact surface 117A expanding in the front/rear direction 8 and the left/right direction 9 while facing upwardly, and a lower contact surface 117B expanding in the front/rear direction 8 and the left/right direction 9 while facing downwardly. The upper contact surface 117A of each of the extended portions 117 is configured to correspond to one of the projections 102 in the rear cover 101 of the first tray 30A. The lower contact surface 117B of each of the extended portions 117 is configured to correspond to one of the projections 103 in the rear cover 101 of the first tray 30A. The upper contact surface 117A of each of the extended portions 117 is located at a position at which at least a portion of the upper contact surface 117A is overlapped with one of the projections 102 in the rear cover 101 of the first tray 30A in the front/rear direction 8 and the left/right direction 9.

<Third Tray 30C>

Figure 10:
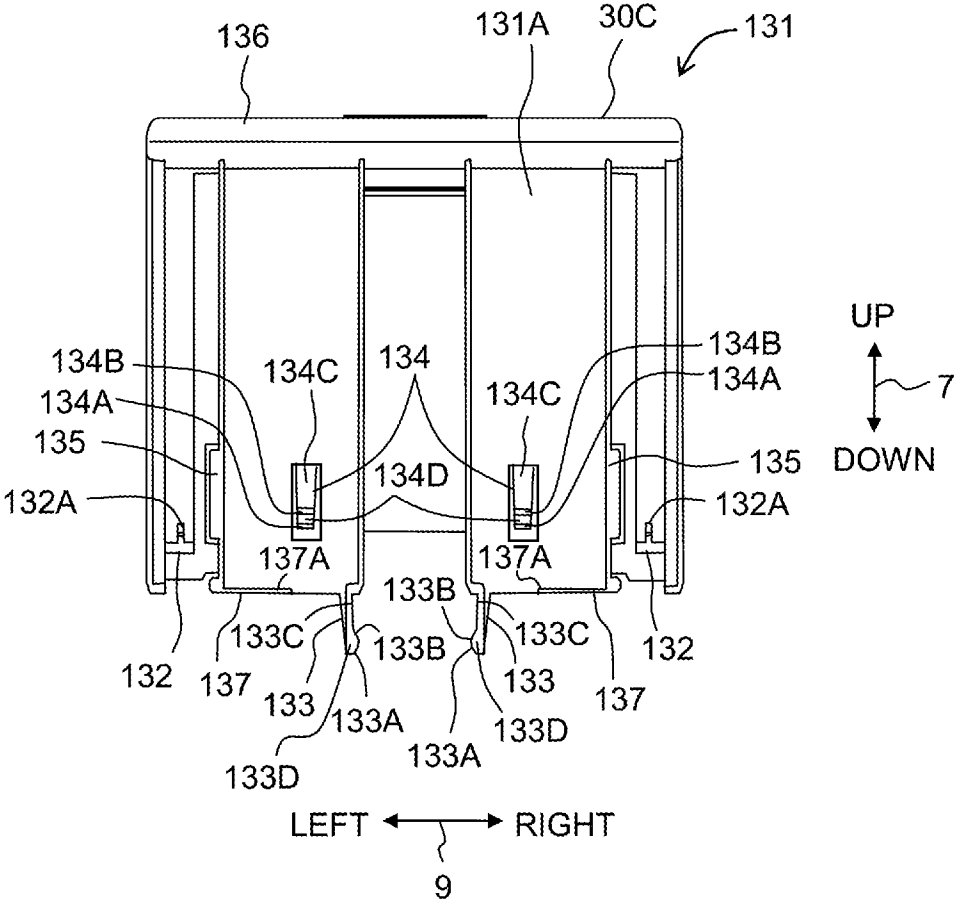
FIG. 10 is a plane view depicting a front surface 131A of a third supporting plate 131 in the third tray 30C.

As depicted in FIG. 10, the third tray 30C has the third supporting plate 131 which is a plate-shaped member expanding along the up/down direction 7 and the left/right direction 9.

The third supporting plate 131 has a third supporting surface 131A expanding entirely in the third supporting plate 131 along the up/down direction 7 and the left/right direction 9, while facing frontwardly.

The third supporting surface 131A is provided with a pair of left and right projections 132, a pair of left and right engaging sections 133, a pair of left and right engaging sections 134 and a pair of left and right guide rails 135. The projections 132, the engaging sections 133, the engaging sections 134 and the guide rails 135 are integrally formed with the third supporting plate 131. The third supporting plate 131 is formed, for example, of a resin.

Figure 15C:
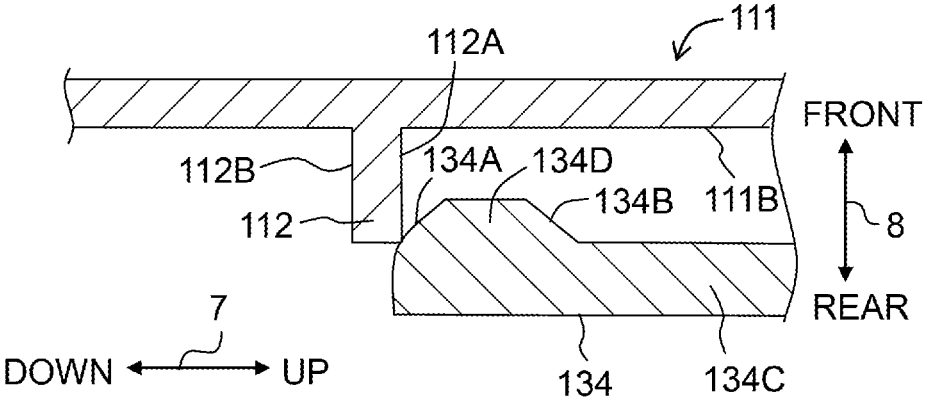
FIG. 15C is a cross-sectional view depicting a state that the engaging section 134 engages with the projection 112.

The engaging sections 134 (an example of a second engaging section) are located at a lower end portion of the third supporting plate 131. As depicted in FIGS. 15A and 15C, each of the engaging sections 134 has an elastic portion 134C configured to be elastically deformable and a projecting portion 134D which projects frontwardly at a lower end portion of the elastic portion 134C. The projecting portion 134D has a downwardly inclined surface 134A which is inclined frontwardly and upwardly (in the up direction) from the lower end of the projecting portion 134D and which faces (is oriented) downwardly, and an upwardly inclined surface 134B which is inclined frontwardly and downwardly (in the down direction) from the upper end of the projecting portion 134D and which faces (is oriented) upwardly. The downwardly inclined surface 134A and the upwardly inclined surface 134B are located in front of the third supporting surface 131A. Each of the engaging sections 134 is formed such that the projecting portion 134D is movable in the front/rear direction 8 by the elastic deformation of the elastic portion 134C. In other words, Each of the engaging sections 134 is formed such that the elastic portion 134C is elastically deformed to thereby allow the projecting portion 134D to be movable in the front/rear direction 8. The engaging sections 134 are configured to correspond to the projections 112 in the second supporting plate 111 of the second tray 30B. Each of the engaging sections 134 is located at a position at which at least a portion of each of the engaging sections 134 is overlapped with one of the projections 112 in the second supporting surface 112 of the second tray 30B in the front/rear direction 8 and the left/right direction 9.

The engaging sections 133 (an example of a third engaging section) are projected downwardly from a lower end edge at a portion located closely to a central portion in the left/right direction 9 of the third supporting plate 131. The projections 133 are located on the inner side in the left/right direction 9 relative to the engaging sections 134. As depicted in FIG. 10, each of the projections 133 has an elastic portion 133C configured to be elastically deformable and a projecting portion 133D which projects inwardly in the left/right direction 9 at a lower end portion of the elastic portion 133C. The projecting portion 133D has a downwardly inclined surface 133A which is inclined inwardly in the left/right direction 9 and upwardly from a lower end of the projecting portion 133D and which is oriented downwardly, and an upwardly inclined surface 133B which is inclined inwardly in the left/right direction 9 and downwardly (in the down direction) from the upper end of the projecting portion 133D and which is oriented upwardly. Each of the engaging sections 133 is formed such that the projecting portion 133D is movable in the left/right direction 9 by the elastic deformation of the elastic portion 133C. In other words, Each of the engaging sections 133 is formed such that the elastic portion 133C is elastically deformed to thereby allow the projecting portion 133D to be movable in the left/right direction 9. The engaging sections 133 are configured to correspond to the projections 95 in the first supporting plate 90 of the first tray 30A.

The contact walls 137 are projected frontwardly from a lower end edge in the third supporting surface 131A of the third supporting plate 131. The contact walls 137 are each formed as a rib extending in the left/right direction 9. The contact walls 137 are located at the outer side in the left/right direction 9 relative to the engaging sections 134. Each of the contact walls 137 has a contact surface 137A expanding in the front/rear direction 8 and the left/right direction 9 while facing upwardly. The contact walls 137 are configured to correspond to projections 120 in the second supporting plate 111 of the second tray 30B. Each of the contact walls 137 is located at a position at which at least a portion of each of the contact walls 137 is overlapped with one of the projections 120 in the second supporting plate 111 of the second tray 30B in the front/rear direction 8 and the left/right direction 9.

The guide rails 135 are projecting frontwardly from a lower end portion in the third supporting surface 131A of the third supporting plate 131, while extending in the up/down direction 7. The guide rails 135 are located at substantially same positions as the outer edges in the left/right direction 9 of the contact walls 137. Each of the guide rails 135 is projected frontwardly, then is bent toward the outer side in the left/right direction 9, and is extending in the up/down direction 7. Each of the guide rails 135 has a sliding surface (not depicted in the drawings) which faces rearwardly and extends along the up/down direction 7 and the front/rear direction 8. The guide rails 135 are configured to correspond to the guide rails 118 in the second supporting plate 111 of the second tray 30B. Each of the guide rails 135 is located at a position at which at least a portion of each of the guide rails 135 is overlapped with one of the guide rails 118 in the second supporting plate 111 of the second tray 30B in the front/rear direction 8 and the left/right direction 9. In a case that each of the guide rails 118 is allowed to enter a location behind the sliding surface of one of the guide rails 135 from the outer side in the left-right direction 9, the guide rails 135 and the guide rails 118 become slidably movable with respect to each other in the up/down direction 7.

The projections 132 are projected frontwardly from an lower end portion in the third supporting surface 131A of the third supporting plate 131. Each of the projections 132 is a rib which is an inverted T-shaped as seen from the front/rear direction 8. The projections 132 are located at the outer side in the left/right direction 9 relative to the guide rails 135. Each of the projections 132 has a contact surface 132A which is expanding in the front/rear direction 8 and the left/right direction 9 and which faces upwardly. The projections 132 are configured to correspond to the projections 113 in the second supporting plate 111 of the second tray 30B. Each of the projections 132 is located at a position at which at least a portion of each of the projections 132 is overlapped with one of the projections 113 in the second supporting surface 111 of the second tray 30B in the front/rear direction 8 and the left/right direction 9.

Figure 11:
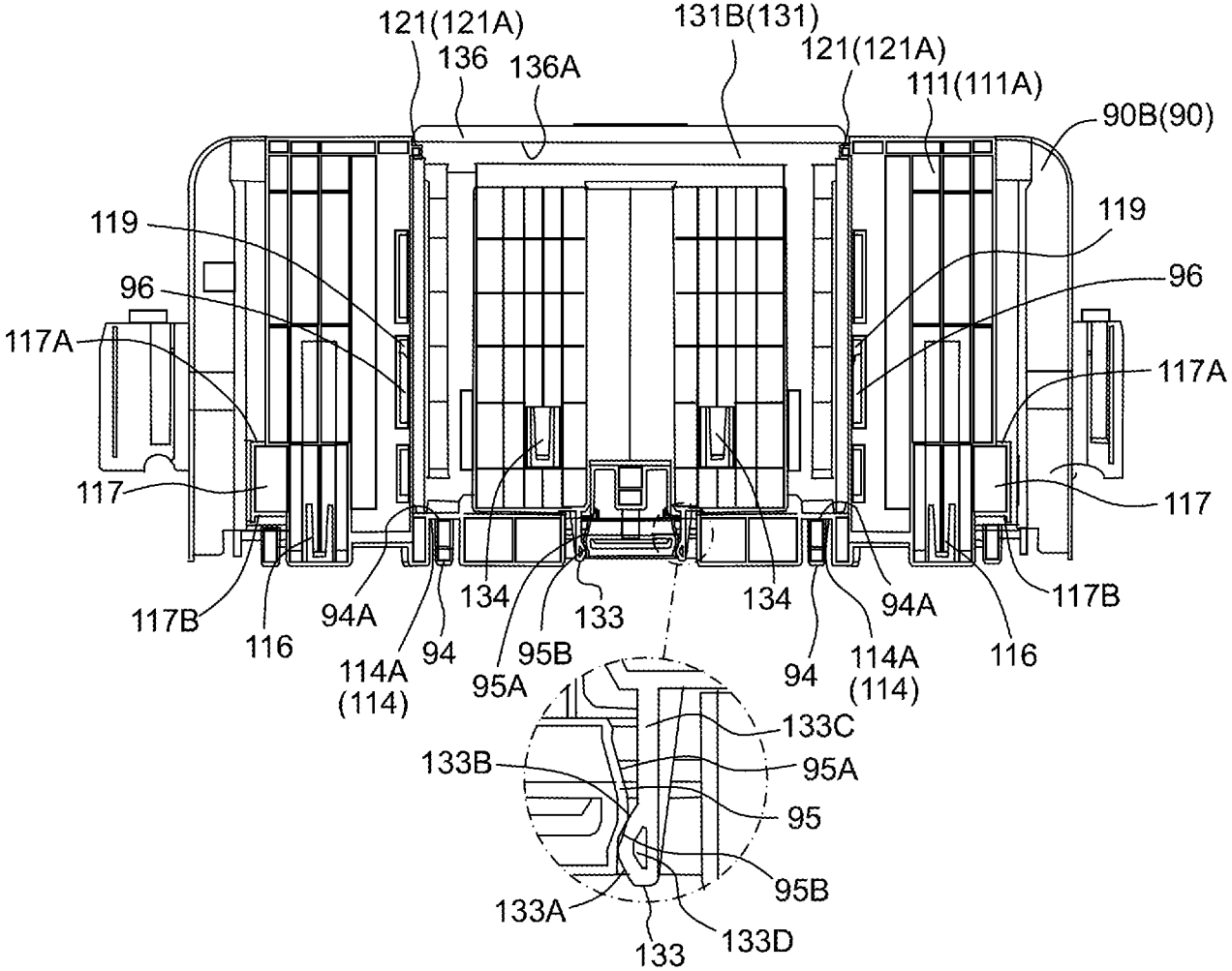
FIG. 11 is a plane view of the first supporting plate 90, the second supporting plate 111 and the third supporting plate 131 of a MP tray 13 in a first state, as seen from a rear side thereof.

The third supporting plate 131 has an operating section 136 which is plate-shaped and formed at an upper end edge of the third supporting surface 131, projecting frontwardly from the supporting surface 131A and expanding along the front/rear direction 8 and the left/right direction 9. The operating section 136 has a rectangular planar shape. As depicted in FIG. 11, the operating section 136 is provided with a lower surface 136A formed in a rear end portion of the operating section 136, expanding along the front/rear direction 8 and the left/right direction 9 while facing downwardly. The lower surface 136A is configured to correspond to the projections 121 of the second supporting plate 111.

<Assembly of First Tray 30A, Second Tray 30B and Third Tray 30C>

As depicted in FIGS. 11 to 14, the first supporting plate 90 of the first tray 30A and the second supporting plate 111 of the second tray 30B are assembled to each other such that the sliding surfaces (not depicted in the drawings) in the guide rails 96 of the first supporting plate 90 and the sliding surfaces 119A in the guide rails 119 of the second supporting plate 111 are opposite to each other. With this, the first supporting plate 90 and the second supporting plate 111 are allowed to be slidable (slidably movable) with respect to each other in the up/down direction 7 (an example of a sliding direction).

The second supporting plate 111 of the second tray 30B and the third supporting plate 131 of the third tray 30C are assembled to each other such that the sliding surfaces (not depicted in the drawings) in the guide rails 118 of the second supporting plate 111 and the sliding surfaces (not depicted in the drawings) in the guide rails 135 of the third supporting plate 131 are opposite to each other. With this, the second supporting plate 111 and the third supporting plate 131 are allowed to be slidable with respect to each other in the up/down direction 7 (an example of the sliding direction).

The rear cover 101 of the first tray 30A is assembled to the first cover 30A such that the peripheral edge portion of the front surface 101A of the rear cover 101 makes contact with the rear end portion of the extended portion 92 of the first supporting plate 90. Then, the screw holes of the projections 106 in the rear cover 101 are positioned and screwed with the through holes 97 of the extended portion 92 in the first supporting plate 90.

<Drawing Operation>

<First State>

A first state depicted in FIG. 11 is a such a state that the second tray 30B and the third tray 30C are stored in the inside of the first tray 30A. In the first state, the second tray 30B is located at a stored position with respect to the first tray 30A (an example of a first position, hereinafter simply referred to as the "stored position of the second tray 30B"). Further, in the first state, the third tray 30C is at a stored position with respect to the second tray 30B (an example of a third position, hereinafter simply referred to as the "stored position of the third tray 30C"). Note the rear cover 101 is omitted in FIGS. 11 to 14 for convenience of explanation.

At the stored position of the second tray 30B, the contact surface 94A of each of the projections 94 in the first supporting plate 90 makes contact, in the up/down direction, with the contact surface 114A of one of the second cutout portions 114 in the second supporting plate 111. Further, the contact surface 103A of each of the projections 103 in the rear cover 101 makes contact, in the up/down direction 7, with the lower surface 117B of one of the extended portions 117 in the second supporting plate 111. With this, downward movement of the second tray 30B to a position below (lower than) the stored position of the second tray 30B with respect to the first tray 30A is regulated or restricted. At the stored position of the second tray 30B, the second supporting plate 111 is overlapped with the first supporting plate 90 in the front/rear direction 8, in a state that the second supporting plate 111 is located on the rear side of the first supporting plate 90.

At the stored position of the third tray 30C, the contact surface 120A of each of the projections 120 in the second supporting plate 111 makes contact, in the up/down direction 7, with the contact surface 137A of one of the contact walls 137 in the third supporting plate 131 (see FIG. 15A). Further, the contact surface 121A of each of the projections 121 in the second supporting plate 111 makes contact, in the up/down direction 7, with one of the end portions in the left/right direction 9 of the lower surface 136A in the operating section 136 (see FIG. 11). With this, downward movement of the third tray 30C to a position lower than the stored position of the third tray 30C with respect to the second tray 30B is regulated or restricted. At the stored position of the third tray 30C, the third supporting plate 131 is overlapped with the second supporting plate 111 in the front/rear direction 8, in a state that the third supporting plate 131 is located on the rear side of the second supporting plate 111.

Furthermore, in the first state, the upwardly inclined surface 133B of each of the engaging sections 133 in the third supporting plate 131 makes contact with the downwardly inclined surface 95B of one of the projections 95 in the first supporting plate 90, and thus the engaging sections 133 engage with the projections 95. With this, in a state that any force sufficient for releasing the engagement of the engaging sections 133 with respect to the projections 95 is not applied to the third tray 30 in the up direction (an example of a drawing direction), upward movement of the third tray 30C to a position above the stored position of the third tray 30C with respect to the second tray 30B is prevented.

In the first state, the second tray 30B and the third tray 30C are positioned in a space defined between the first supporting plate 90 and the rear cover 101 of the first tray 30A.

Figure 14:
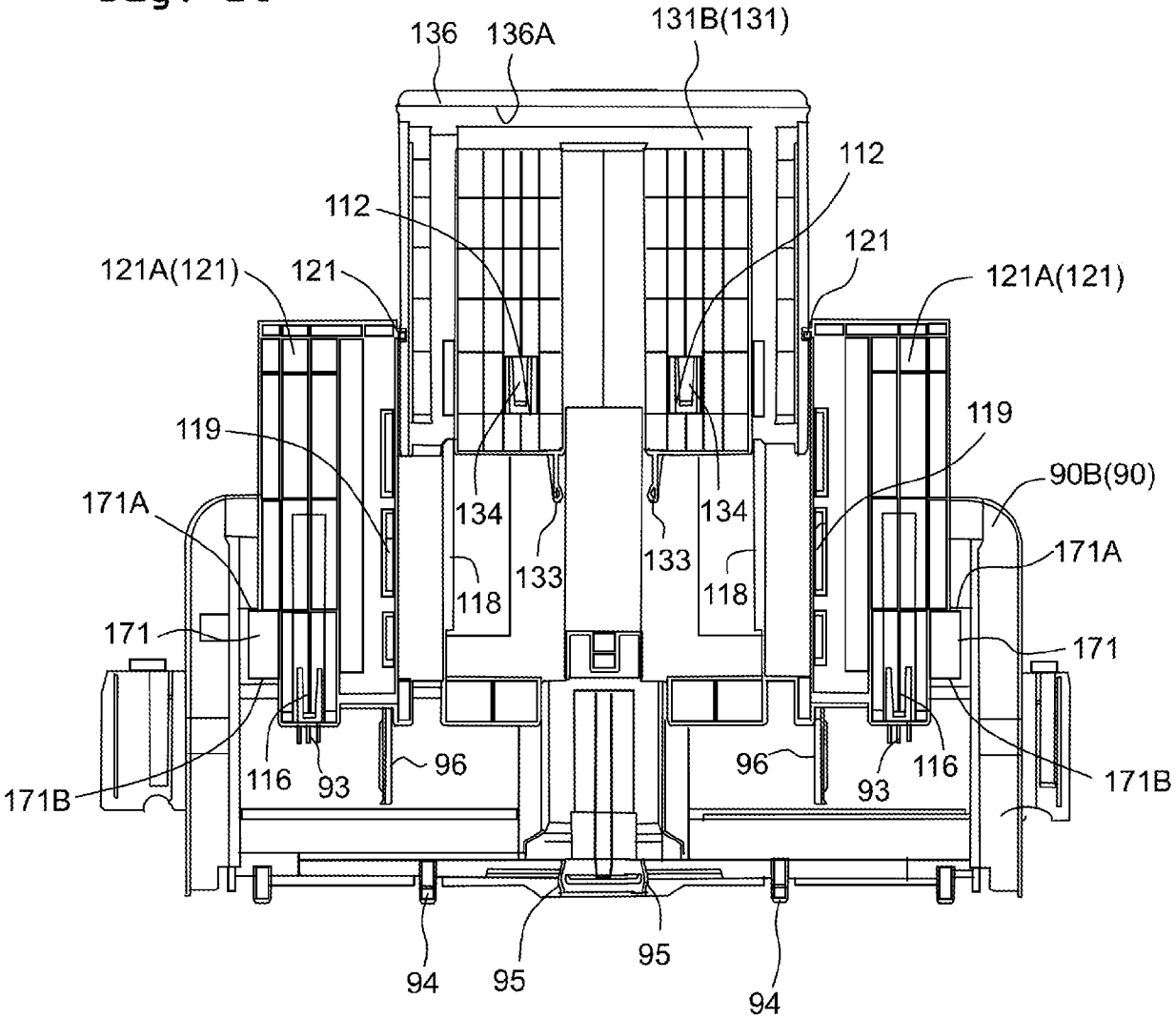
FIG. 14 is a plane view of the first supporting plate 90, the second supporting plate 111 and the third supporting plate 131 of the MP tray 13 in a fourth state, as seen from the rear side thereof.

In a case that a user operates the operating section 136 of the third tray 30C in the first state so as to lift (draw or pull) the third tray 30C from the first state upwardly, the tray body 30 is eventually changed to have an elongated state depicted in FIG. 14.

In a case that the third tray 30C is moved from the first state upwardly via the through holes 97, the engagement of the engaging sections 133 with respect to the projections 95 is released. Specifically, at first, the projecting portion 133D of each of the engaging sections 133 slidably moves in the downwardly inclined surface 95B and moves upwardly. Accompanying with this, the elastic portion 133C of each of the engaging sections 133 is elastically deformed, thereby allowing the projecting portion 133D to move outwardly in the left/right direction 9 along the downwardly inclined surface 95B. Then, after the projecting portion 133D climbs over the downwardly inclined surface 95B to be a position above the downwardly inclined surface 95B, the projecting portion 133D moves upwardly while moving to the inner side in the left/right direction 9 along the upwardly inclined surface 95A.

Afterwards, the third tray 30C moves upwardly, while the second tray 30C is remaining in a stopped state (non-moving state). Then, the tray body 30 reaches a second state as depicted in FIG. 12.

<Second State>

Figure 12:
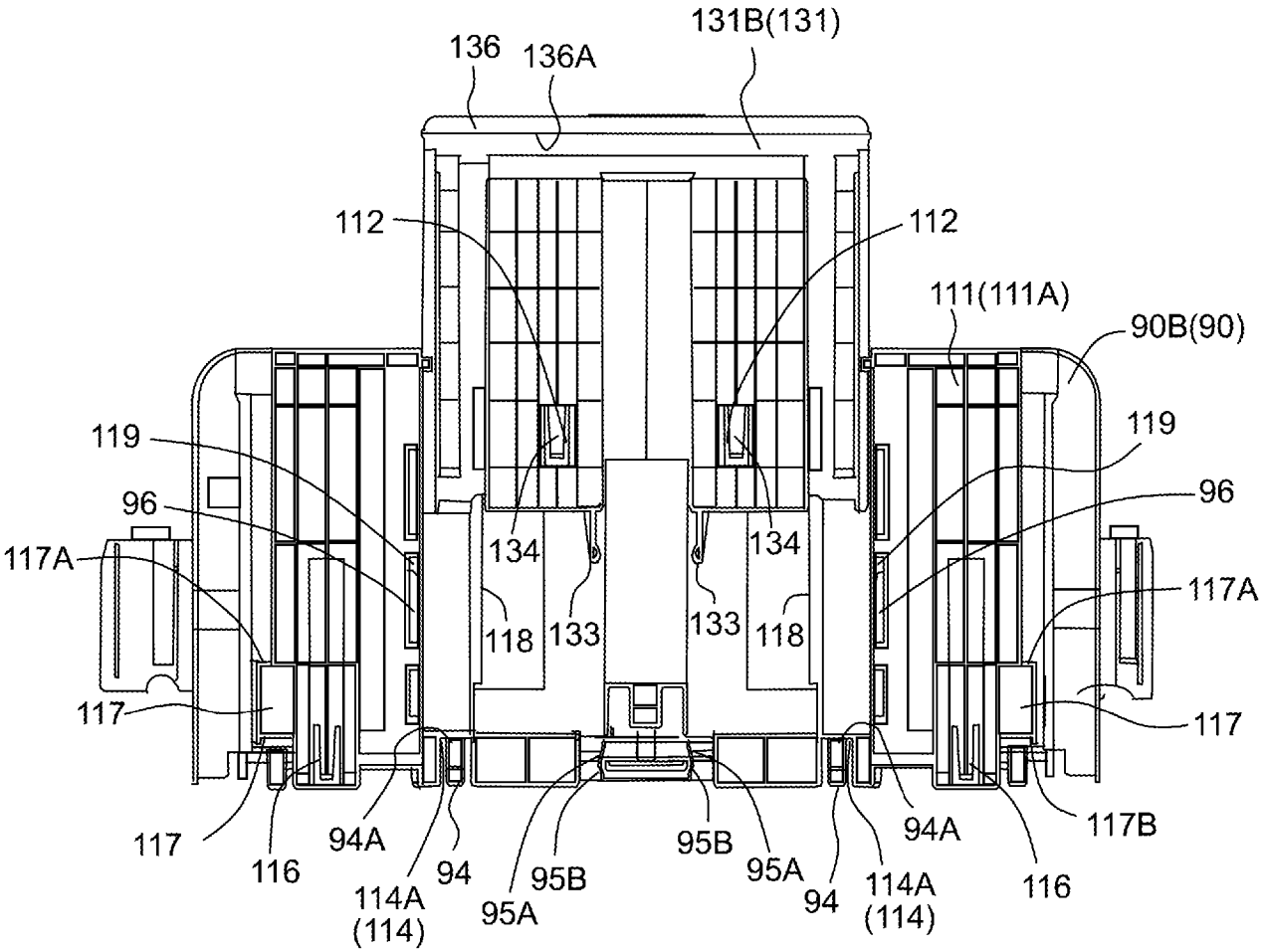
FIG. 12 is a plane view of the first supporting plate 90, the second supporting plate 111 and the third supporting plate 131 of the MP tray 13 in a second state, as seen from the rear side thereof.

In the second state depicted in FIG. 12, the second tray 30B is at the stored position with respect to the first tray 30A. Further, in the second state, the third tray 30C is located at a first contact position (an example of a fifth position). The first contact position in a position at which the lower surface 112B of each of the projections 112 in the second supporting plate 111 makes contact, in the up/down direction 7, with the upwardly inclined surface 134B of one of the engaging sections 134 in the third supporting plate 131 (see FIG. 15A).

Namely, in a drawing process for drawing the third tray 30C from the first state up to the second state, the state in which the projections 112 and the engaging sections 134 are apart (separated) from each other is changed to the contact state, as depicted in FIG. 15A, in which the projections 112 and the engaging sections 134 make contact with each other.

In a case that the third tray 30C is further moved upwardly from the second state, the engaging sections 134 of the third supporting plate 131 pull the projections 112 of the second supporting plate 111, without climbing over the projections 112. A force required for elastically deforming the elastic portion 134C of each of the engaging sections 134 in a direction separating the projecting portion 134D of each of the engaging sections 134 away from one of the projections 112 is greater than the force for pulling the second tray 30B upwardly (for example, the weight of the second tray 30B). Accordingly, the second tray 30 is moved upwardly via the through holes 97, following the movement of the third tray 30C. Then, the second tray 30B is moved up to a second contact position with respect to the first tray 30A. The second contact position is a position at which the downwardly inclined surface 93B of each of the projections 93 in the first supporting plate 90 makes contact, in the up/down direction 7, with the upwardly inclined surface 116B of one of the engaging sections 116 in the second supporting plate 111.

Figure 13:
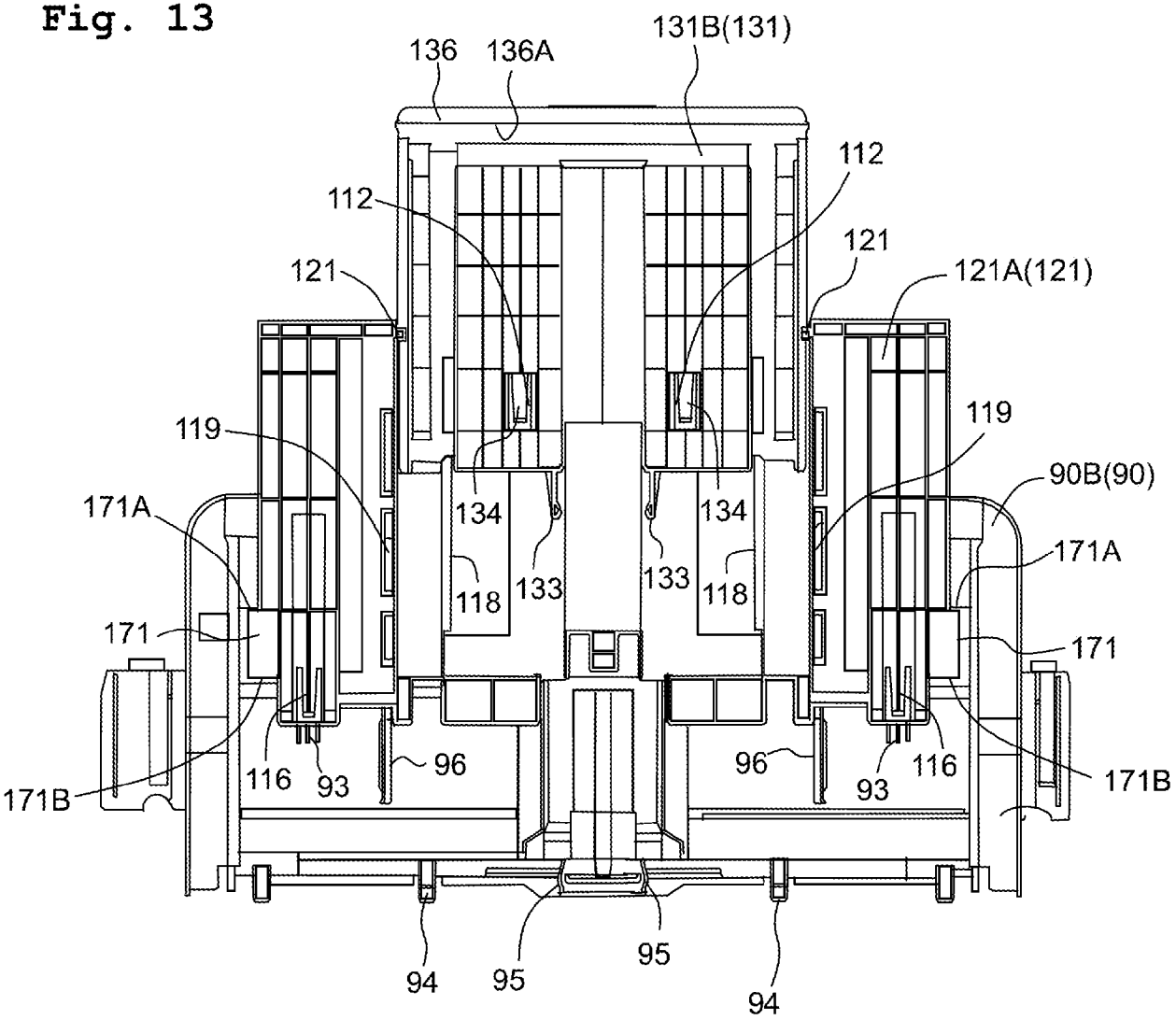
FIG. 13 is a plane view of the first supporting plate 90, the second supporting plate 111 and the third supporting plate 131 of the MP tray 13 in a third state, as seen from the rear side thereof.

In a case that the third tray 30C is moved further upwardly from a state that the third tray 30C is located at the first contact position and the second tray 30B is located at the second contact position, a rearward force is applied, by the downwardly inclined surface 93B of each of the projecting portions 93, to the upwardly inclined surface 116B of one of the engaging sections 116 in the second supporting plate 111. A force for elastically deforming the elastic portion 116C in a direction separating the projecting portion 116D of each of the engaging sections 116 away from one of the projections 93 (namely, in a rearward direction) is weaker than the force applied to the upwardly inclined surface 116B by the downwardly inclined surface 93B when the third tray 30C located at the first contact position with respect to the second tray 30B is pulled upwardly (for example, the elastic deformation force of the elastic portion 134C of each of the engaging sections 134). Accordingly, the elastic portion 116C of each of the engaging sections 116 is elastically deformed so as to allow the upwardly inclined surface 116B to move in a direction for separating the upwardly inclined surface 116B away from the projection 93 (in a rearward direction). With this, the contact between the downwardly inclined surface 93B of each of the projections 93 and the upwardly inclined surface 116B of one of the engaging sections 116 is released, thereby allowing the third tray 30 to move further upwardly with respect to the second tray 30B. Then, the state of the tray body 30 reaches a third stated as depicted in FIG. 13.

<Third State>

In the third state depicted in FIG. 13, the second tray 30B is at a drawn position with respect to the first tray 30A (an example of a second position; hereinafter referred to simply as the "drawn position of the second tray 30B). Further, in the third state, the second tray 30B is located at the first contact position.

At the drawn position of the second tray 30B, the contact surface 102A of each of the projections 102 in the rear cover 101 of the first tray 30A makes contact, in the up/down direction 7, with the upper contact surface 117A of one of the extended portions 117 in the second supporting surface 111 of the second tray 30B. With this, upward movement of the second tray 30B up to a position above the drawn position of the second tray 30B with respect to the first tray 30A is regulated. Also at the drawn position of the second tray 30B, the second supporting plate 111 is overlapped with the first supporting plate 90 in the front/rear direction 8, in a state that the second supporting plate 111 is located behind (located on the rear side of) the first supporting plate 90, with an overlapping area smaller than that in the case that the second tray 30B is located at the first position.

Further, at the drawn position of the second tray 30B with respect to the first tray 30A, the downwardly inclined surface 116A in each of the engaging sections 116 in the second supporting plate 111 of the second tray 30B makes contact, in the up/down direction 7, with the upwardly inclined surface 93A of one of the projections 93 in the first supporting plate 90 of the first tray 30A, and thus the engaging sections 116 engage with the projections 93 (see FIG. 15B). With this, in a state that the user is not pressing the second tray 30B and the third tray 30B in a direction opposite to the drawing direction 5 so as to store the second tray 30B and the third tray 30C in the first tray 30A, downward movement of the second tray 30B to a position below the stored position of the second tray 30B with respect to the first tray 30A is prevented.

Since the upwardly inclined surface 93A and the downwardly inclined surface 93B of each of the projections 93 are inclined as depicted in FIG. 15B, the projecting portion 116D of one of the engaging sections 116 is gradually moved rearwardly, and then is gradually moved frontwardly during a process that the engaging sections 116 are engaging with the projection 93. Further, at the drawn position of the third tray 30C, the elastic deformation in the rear direction of the elastic portion 134C of each of the engaging sections 134 is in a state of being returned in the front direction to a small extent, and the projecting portion 116D does not make contact with the rear surface 90B of the first supporting plate 90 in the engagement. Therefore, any vibration which would be otherwise occurred by the engagement hardly occurs. In addition to this, the moving speed of the projecting portion 116D of each of the engaging sections 116 in the front/rear direction 8 is small due to the presence of the upwardly inclined surface 93A and the downwardly inclined surface 93B of each of the projections 93, which in turn causes the user to hardly feel any click feeling.

Further, since the elastic deformation of the elastic portion 134C of each of the engaging sections 134 is in the state of being returned in the front direction by a small extent, the projecting portion 116D of each of the engaging sections 116 is in a state of being urged toward the upwardly inclined surface 93A of one of the projections 93. This urging force is converted by the inclination of the upwardly inclined surface 93A to a force urging the second tray 30B upwardly. With this, the second tray 30B is urged upwardly in a state that the contact surface 102A of each of the projections 102 of the first tray 30A makes contact, in the up/down direction 7, with the upper contact surface 117A of one of the extended portions 117 of the second tray 30B. Accordingly, this suppresses any movement in the up/down direction 7 (unsteadiness, rattling) of the second tray 30B.

Since the upward movement of the second supporting plate 111 is regulated, in a case that the third tray 30C is moved further upwardly from the third state, a rearward force is applied by each of the projections 112 to the upwardly inclined surface 134B of one of the engaging sections 134 of the third supporting plate 131. The engaging sections 134 are formed such the force elastically deforming the engaging sections 134 rearwardly is weaker than this force applied to the upwardly inclined surface 134B. Accordingly, each of the engaging sections 134 is elastically deformed to thereby allow the upwardly inclined surface 134B to move rearwardly. With this, the contact between the lower surface 112B of each of the projections 112 and the upwardly inclined surface 134B of one of the engaging sections 134 is released, and thus the third tray 30C is allowed to move further upwardly. Then, the state of the third tray 30C reaches a fourth state as depicted in FIG. 14.

<Fourth State>

In the fourth state, the second tray 30B is at the drawn position with respect to the first tray 30A. Further, in the fourth state, the third tray 30C is located at a drawn position with respect to the second tray 30B (an example of a fourth position; hereinafter referred to simply as the "drawn position of the third tray 30C).

At the drawn position of the third tray 30C, the contact surface 113A of each of the projections 113 in the second supporting plate 111 of the second tray 30B makes contact, in the up/down direction 7, with the contact surface 132A of one of the projections 132 in the third supporting surface 131 of the third tray 30C. With this, upward movement of the third tray 30C up to a position above the drawn position of the third tray 30C with respect to the second tray 30B is regulated. Also at the drawn position of the third tray 30C, the third supporting plate 131 is overlapped with the second supporting plate 111 in the front/rear direction 8, in a state that the third supporting plate 131 is located behind (located on the rear side of) the second supporting plate 111, with an overlapping area smaller than that in the case that the third tray 30C is located at the third position.

Further, at the drawn position of the third tray 30C with respect to the second tray 30B, the upper surface 112A of each of the projections 112 in the second supporting plate 111 of the second tray 30B makes contact, in the up/down direction 7, with the downwardly inclined surface 134A in one of the engaging sections 134 in the third supporting plate 131 of the third tray 30C, and thus the engaging sections 134 engage with the projections 112 (see FIG. 15C). With this, in a state that the user is not pressing the third tray 30C downwardly so as to store the third tray 30C in the first tray 30A, downward movement of the third tray 30C to a position below the drawn position of the third tray 30C with respect to the second tray 30B is prevented.

The upper surface 112A and the lower surface 112B of each of the projections 112 are expanding along the front/rear direction 8 and the left/right direction 9 but are not inclined in the up/down direction 7. Therefore, in a process (operation) in which the third tray 30C is being moved upwardly and when the engaging sections 134 are engaging with the projections 112, the projecting portion 134D of each of the engaging sections 134 is moved rabidly rearwardly, and then climbs over the projection 112, and then is moved rapidly frontwardly. Further, the elastic deformation in the rear direction of the elastic portion 134C of each of the engaging sections 134 is in a state of being fully returned in the front direction, which in turn causes the user to feel a strong (large) click feeling.

<Storing Operation>

In a case that a downward force is applied to the operating section 136 of the third tray 30C in the tray body 30 in the fourth state, at first, the engagement of the engaging sections 116 of the second tray 30B with respect to the projections 93 in the first supporting plate 90 of the first tray 30A is released. During this process, the force applied to the downwardly inclined surface 116A of each of the engaging sections 116 by the upwardly inclined surface 93A of one of the projections 93, the elastic portion 116C of each of the engaging sections 116 is elastically deformed such that the projecting portion 116D of each of the engaging sections 116 is moved rearwardly. After that, the projecting portion 116D of each of the engaging sections 116 climbs over one of the projections 93, thereby allowing the elastic portion 116C to be elastically returned (restored). This is caused because the engaging force of the engaging sections 116 of the second tray 30B with respect to the projections 93 in the first supporting plate 90 of the first tray 30A is weaker than the engaging force of the engaging sections 134 in the third supporting plate 131 of the third tray 30C with respect to the projections 112 of the second tray 30B. With this, the second tray 30B is moved downwardly. Then, the state of the tray body 30 is changed to a state that the second tray 30B is located at the stored position and the third tray 30C is located at the drawn position.

In a case that the downward force is further applied to the operating section 136 of the third tray 30C in the tray body 30 in this state, the engagement of the engaging sections 134 of the third tray 30C with respect to the projections 112 of the second tray 30B is released. During this process, the force applied to the downwardly inclined surface 134A of each of the engaging sections 134 by the upper surface 112A of one of the projections 112, the elastic portion 134C of each of the engaging sections 134 is elastically deformed such that the projecting portion 134D of each of the engaging sections 134 is moved rearwardly. After that, the projecting portion 134D of each of the engaging sections 134 climbs over one of the projections 112, thereby allowing the elastic portion 134C to be elastically returned. With this, the third tray 30C is moved downwardly. Then, the third tray 30C is moved up to a third contact position with respect to the first tray 30A. At the third contact position, the upwardly inclined surface 95A of each of the projections 95 in the first supporting plate 90 makes contact, in the up/down direction 7, with the downwardly inclined surface 133A of one of the engaging sections 133 in the third supporting plate 131.

In a case that the third tray 30C is further moved downwardly from this position, a force outwardly in the left/right direction 9 is applied to the downwardly inclined surface 133A of each of the engaging sections 133 in the third supporting plate 131, by one of the projections 95. In a case that a force stronger than the force elastically deforming the engaging sections 133 outwardly in the left/right direction 9 is applied to the operating section 136, the engaging sections 133 are thereby elastically deformed so as to move the downwardly inclined surfaces 133A outwardly in the left/right direction 9. With this, the projecting portion 133D of each of the engaging sections 133 is guided by the upwardly inclined surface 95A of one of the projections 95, and the elastic portion 133C is elastically deformed such that the projecting portion 133D is moved outwardly in the left/right direction 9. Afterwards, when the projecting portion 133D climbs over a ridge defined between the upwardly inclined surface 95A and the downward inclined surface 95B, the projecting portion 133D is guided by the downwardly inclined surface 95B, and the elastic portion 133C is elastically deformed such that the projecting portion 133D is moved inwardly in the left/right direction 9. With this, the third tray 30C is moved downwardly, and the state of the third tray 30C is returned to the first state.

Effects of Embodiment

As described above, in a case that the third tray 30C is moved upwardly, the third tray 30C is moved to the contact position with respect to the second tray 30B, and the engaging sections 134 of the third tray 30C make contact, in the up direction, with the projections 112 of the second tray 30B. In a case that the third tray 30C is moved further upwardly, the second tray 30B and the third tray 30C are integrally moved (the second tray 30B is moved together with the third tray 30C) upwardly in a state that the engaging sections 134 are making contact with the projections 112 of the second tray 30B. In a case that the second tray 30B is moved up to the drawn position of the second tray 30B, the engaging sections 116 of the second tray 30B engage with the projections 93 of the first tray 30A. Further, in a case that the third tray 30C is moved up to the drawn position of the third tray 30C, the engaging sections 134 of the third tray 30C engage with the projections 112 of the second tray 30B. In such a manner, in a state that the second tray 30B is moved up to the drawn position of the second tray 30B and that the third tray 30C is moved up to the drawn position of the third tray 30C, the first tray 30A, the second tray 30B and the third tray 30C engage with one another.

Before the engaging sections 134 of the third tray 30C engage with the projections 112 of the second tray 30B, the engaging sections 116 of the second tray 30B engage with the projections 93 of the first tray 30A. Accordingly, it is possible to suppress such a situation that the sheet tray is used only the third tray 30C is drawn.

By moving the third tray 30C from the contact position with respect to the second tray 30B toward the drawn position of the third tray 30C in the state that the engaging sections 116 of the second tray 30B engage with the projections 93 of the first tray 30A, the engaging sections 134 of the third tray 30C are thereby elastically deformed so as to release the contact with respect to the projections 112 of the second tray 30B, and the third tray 30C is easily moved to the drawn position of the third tray 30C.

The click feeling perceived by the user with respect to the engagement of the engaging sections 116 of the second tray 30B is made to be small. Accordingly, when the user perceives a large click feeling, namely, when the engaging sections 134 of the third tray 30C engage with the projections 112 of the second tray 30B, the state is achieved wherein the engaging sections 116 and the engaging sections 134 are both in the engaged states thereof, respectively. Accordingly, it is possible to easily grasp the state that the second tray 30B is located at the drawn position of the second tray 30B and that the third tray 30C is located at the drawn position of the third tray 30C, namely the state that the second tray 30B and the third tray 30C are both in a fully drawn state thereof.

Further, the second tray 30B receives the force in the up direction, due to the urging force brought about by each of the engaging sections 116 with respect to the upwardly inclined surface 93A of one of the projections 93. Namely, the second tray 30B at the drawn position of the second tray 30B receives the force in the up direction in a state that the movement of the second tray 30B in the up direction is restricted (regulated). Accordingly, the movement of the second tray 30B in both directions in the up/down direction 7 is suppressed.

The drawing direction for each of the second and third trays 30B and 30C is the up direction. Accordingly, in a case that the movements of the second and third trays 30B and 30C are stopped (aborted) in a state that the second tray 30B has not moved up to the drawn position of the second tray 30B and that the third tray 30C has not moved up to the drawn position of the third tray 30C, the second and the third trays 30B and 30C easily return to the stored positions thereof, respectively, due to the gravity. Accordingly, the user can easily grasp the state that all the trays are completely drawn.

The third tray 30C is provided with the engaging sections 133 configured to engage with the first tray 30A under a condition that the second tray 30B is located at the stored position of the second tray 30B and that the third tray 30C is located at the stored position of the third tray 30C. Accordingly, the MP tray 13 is maintained in the state that the second tray 30B and the third tray 30C are both at the stored positions, respectively.

The rear surface 111B of the second supporting plate 111 of the second tray 30B and the rear surface 131B of the third supporting plate 131 of the third tray 30C are covered (hidden) by the rear cover 101. Accordingly, the outer appearance of the MP tray 13 can be improved. Further, the second and third trays 30B and 30C can be protected by the rear cover 101.

In the state that both of the second tray 30B and the third tray 30C are located at the stored positions thereof, respectively, the second and third trays 30B and 30C are in a state of being covered (hidden) by the first tray 30A. Accordingly, in this state, the outer appearance of the MP tray 13 can be improved. Further, the MP tray 13 can be made compact.

MODIFICATIONS

In the above-described embodiment, the engaging sections 116 are formed integrally with the second supporting plate 111 of the second tray 30B, and the second supporting plate 111 is formed of a resin. Accordingly, the elastic deformation of the engaging sections 116 is elastic deformation of the resin forming the engaging sections 116. In contrast to this, for example, it is allowable that the engaging sections 116 are configured to be movable relative to the second supporting plate 111 such that the downwardly inclined surface 116A of each of the engaging sections 116 is movable in the front/rear direction 8, and that each of the engaging sections 116 is urged by an elastic member, such as a spring, in a direction of allowing the downwardly inclined surface 116A of each of the engaging sections 116 to make contact with the downwardly inclined surface 93B of one of the projections 93. This is similarly applicable also to the engaging sections 134 and 133.

Further, in the engagements regarding the engaging sections 116, 133 and 134, the engaging sections 116, 133 and 134 are each an elastically deformable member, and the projections 93, 95 and 112 each are not an elastically deformable member. However, it is allowable to adopt a configuration wherein the engaging sections 116, 133 and 134 each are not an elastically deformable member, and the projections 93, 95 and 112 are each an elastically deformable member. Furthermore, it is also allowable to adopt a configuration wherein both of the engaging sections 116, 133 and 134 and the projections 93, 95 and 112 are elastically deformable.

Moreover, provided that the engaging sections 116, 133 and 134 are engageable with the projections 93, 95 and 112, respectively, the direction in which the engaging sections 116, 133 and 134 are elastically deformed and the direction in which the projections 93, 95 and 112 are projected can be changed in any way. Further, the direction in which other projection(s) regarding the engagement are projected can be changed in any way, as well.

What is claimed is:

1. A sheet tray configured to support a sheet comprising:

a first tray including a first supporting surface configured to support the sheet;

a second tray including a second supporting surface configured to support the sheet, in a state that at least a portion of the second supporting surface is located on an opposite side of the first supporting surface in an orthogonal direction orthogonal to the first supporting surface, the second tray being supported by the first tray such that the second tray is slidably movable in a sliding direction, which is along the first supporting surface, between a first position and a second position, wherein the first position is a position at which the second supporting surface is overlapped with the first supporting surface, and the second position is a position at which the second supporting surface is overlapped with the first supporting surface and at which an overlapping area of the second supporting surface with respect to the first supporting surface is smaller than that at the first position; and a third tray including a third supporting surface configured to support the sheet, in a state that at least a portion of the third supporting surface is located on an opposite side of the second supporting surface in an orthogonal direction orthogonal to the second supporting surface, the third tray being supported by the second tray such that the third tray is slidably movable in the sliding direction between a third position and a fourth position, wherein the third position is a position at which the third supporting surface is overlapped with the second supporting surface, and the fourth position is a position at which the third supporting surface is overlapped with the second supporting surface and at which an overlapping area of the third supporting surface with respect to the second supporting surface is smaller than that at the third position, wherein the second tray includes a first engaging section configured to engage with the first tray at the second position;

the third tray includes a second engaging section configured to make contact with the second tray, in a drawing direction from the first position toward the second position, under a condition that the third tray is arranged at a fifth position located between the third and fourth positions, the second engaging section being configured to engage with the second tray at the fourth position;

the second engaging section is configured to be elastically deformable such that the second engaging section is movable in a releasing direction in which the contact between the second engaging section and the second tray is released; and the second tray and the third tray are configured to be movable integrally in the drawing direction in a state that the second engaging section makes contact with the second tray.

2. The sheet tray according to claim 1, wherein under a condition that the second tray and the third tray are integrally moved in the drawing direction in the state that the second engaging section makes contact with the second tray, the first engaging section engages with the first tray.

3. The sheet tray according to claim 1, wherein under a condition that the third tray is moved from the fifth position toward the fourth position in a state that the first engaging section engages with the first tray, the second engaging section is elastically deformed so as to release the contact between the second engaging section and the second tray.

4. The sheet tray according to claim 3, wherein the first tray includes: a first supporting plate including the first supporting surface, a first projection projecting from the first supporting plate in a projecting direction orthogonal to the sliding direction, and a guide rail supported by the first supporting plate and configured to guide the second tray in the sliding direction;

the first supporting plate includes a projection supporting surface, and a second projection projecting from the projection supporting surface in the projecting direction orthogonal to the sliding direction;

the second projection includes an inclined surface which is oriented in the drawing direction and which is inclined in a direction approaching closely to the projection supporting surface toward the drawing direction;

the second tray includes a second supporting plate including the second supporting surface;

the second supporting plate including a third projection projecting from the second supporting plate in a direction opposite to the projecting direction of the first projection, and configured to make contact with the first projection in the drawing direction in a state that the second tray is located at the second position;

the first engaging section includes an elastic portion configured to be elastically deformable, and a projecting portion projecting from the elastic portion toward the projection supporting surface; and in the state that the first engaging section engages with the first tray, the elastic portion is elastically deformed to thereby allow the projecting portion to make contact with the inclined surface while urging the projection portion against the inclined surface, and the projecting portion does not make contact with the projection supporting surface.

5. The sheet tray according to claim 1, wherein the drawing direction is an up direction.

6. The sheet tray according to claim 1, wherein the third tray includes a third engaging section configured to engage with the first tray under a condition that the second tray is located at the first position and that the third tray is located at the third position.

7. The sheet tray according to claim 1, wherein the first tray includes the first supporting surface, a first supporting plate including an extended portion extended from a peripheral edge portion of the first supporting surface in an opposite direction opposite to the first supporting surface, and a cover arranged on the opposite side of the first supporting surface in the orthogonal direction orthogonal to the first supporting surface to be away from the first supporting surface; and the second tray and the third tray are positioned in a space defined between the first supporting plate and the cover in a state that the second tray is located at the first position and that the third tray is located at the third position.

8. The sheet tray according to claim 7, wherein the extended portion includes a through hole penetrating through the extended portion in the sliding direction;

the second tray is moved via the through hole from the first position in the drawing direction; and the third tray is moved via the through hole from the third position in the drawing direction.

9. A sheet conveying apparatus comprising:

a main body;

the sheet tray as defined in claim 1; and a feeding section configured to feed the sheet supported by the sheet tray to the main body.

* * * * *